US010141656B2

(12) United States Patent
Urcia et al.

(10) Patent No.: US 10,141,656 B2
(45) Date of Patent: Nov. 27, 2018

(54) STRUCTURAL ANTENNA ARRAY AND METHOD FOR MAKING THE SAME

(71) Applicant: The Boeing Company, Chicago, IL (US)

(72) Inventors: Manny S. Urcia, Wildwood, MO (US); Matthew A. Stoneback, San Francisco, CA (US); Tiffany M. Radford, Wentzville, MO (US); Mark T. Chisa, Sumner, WA (US); Mark A. Thompson, Seattle, WA (US); Benjamin D. Smith, Maryland Heights, MO (US); Charles W. Manry, Jr., Auburn, WA (US)

(73) Assignee: The Boeing Company, Chicago, IL (US)

( * ) Notice: Subject to any disclaimer, the term of this patent is extended or adjusted under 35 U.S.C. 154(b) by 409 days.

(21) Appl. No.: 14/988,869

(22) Filed: Jan. 6, 2016

(65) Prior Publication Data

US 2017/0194715 A1 Jul. 6, 2017

(51) Int. Cl.

| | |
|---|---|
| ***H01Q 21/00*** | (2006.01) |
| ***H01Q 21/06*** | (2006.01) |
| ***H01Q 9/06*** | (2006.01) |
| ***H01Q 1/38*** | (2006.01) |
| ***H01Q 1/28*** | (2006.01) |
| ***H01Q 21/24*** | (2006.01) |

(52) U.S. Cl.

CPC ..... *H01Q 21/062* (2013.01); *H01Q 1/28* (2013.01); *H01Q 1/286* (2013.01); *H01Q 1/38* (2013.01); *H01Q 9/065* (2013.01); *H01Q 21/0087* (2013.01); *H01Q 21/24* (2013.01)

(58) Field of Classification Search

CPC ..... H01Q 1/28; H01Q 1/286; H01Q 9/065; H01Q 21/061–21/062; H01Q 21/24

See application file for complete search history.

(56) References Cited

U.S. PATENT DOCUMENTS

| | | | |
|---|---|---|---|
| 5,786,792 | A | 7/1998 | Bellus et al. |
| 6,333,712 | B1 | 12/2001 | Haugse et al. |
| 6,512,487 | B1 | 1/2003 | Taylor et al. |
| 7,046,209 | B1 | 5/2006 | McCarville et al. |
| 7,109,942 | B2 | 9/2006 | McCarville et al. |
| 7,109,943 | B2 | 9/2006 | McCarville et al. |
| 7,113,142 | B2 | 9/2006 | McCarville et al. |
| 8,446,330 | B1 | 5/2013 | McCarville et al. |

(Continued)

OTHER PUBLICATIONS

Munk, "Finite Antenna Arrays and FSS," John Wiley (2003).

(Continued)

*Primary Examiner* — Dameon E Levi
*Assistant Examiner* — Hasan Islam
(74) *Attorney, Agent, or Firm* — Walters & Wasylyna LLC

(57) ABSTRACT

A structural antenna array may include a core including intersecting wall sections, wherein the core further includes antenna elements formed on a first surface of the wall sections, and feed elements formed on a second surface of the wall sections, a distribution substrate layer coupled to the core and in electrical communication with the antenna elements and the feed elements, a first skin coupled to the core opposite the distribution substrate layer, and a second skin coupled to the distribution substrate layer opposite the first skin.

20 Claims, 15 Drawing Sheets

(56) References Cited

U.S. PATENT DOCUMENTS

| | | | | |
|---|---|---|---|---|
| 8,643,554 | B1 | 2/2014 | Manry, Jr. et al. | |
| 8,661,649 | B1 | 3/2014 | Urcia et al. | |
| 8,912,975 | B1 | 12/2014 | Hafenrichter et al. | |
| 8,972,310 | B2 | 3/2015 | Kearns et al. | |
| 9,099,777 | B1 | 8/2015 | Manry, Jr. | |
| 9,172,147 | B1 | 10/2015 | Manry, Jr. | |
| 9,190,727 | B1 | 11/2015 | Urcia et al. | |
| 9,368,879 | B1 | 6/2016 | Manry, Jr. | |
| 2006/0097944 | A1 | 5/2006 | McCarville et al. | |
| 2006/0097947 | A1 | 5/2006 | McCarville et al. | |
| 2014/0152510 | A1 | 6/2014 | Manry, Jr. et al. | |
| 2014/0320366 | A1 | 10/2014 | Urcia et al. | |
| 2015/0303586 | A1 | 10/2015 | Hafenrichter et al. | |
| 2016/0156109 | A1* | 6/2016 | Anderson ..... | H01Q 21/0093 343/852 |

OTHER PUBLICATIONS

Hansen, "Non-Foster and Connected Planar Arrays," *Radio Science*, vol. 39, RS4004 (2004).

Schauber et al., "Vivaldi Antenna Arrays for Wide Beam-width and Electronic Scanning," IEEE AP-S EuCAP 2007 Conference paper (2007).

Holland et al, "Design and Fabrication of Low Cost PUMA Arrays," IEEE AP-S Jul. 2011 Conference proceedings (2011).

Pozar et al., "Scan Blindness in Infinite Phased Arrays of Printed Dipoles," IEEE AP-S AP-32 (1984).

European Patent Office, Extended European Search Report, EP 17 15 0149 (dated Jun. 2, 2017).

* cited by examiner

STRUCTURAL ANTENNA ARRAY AND METHOD FOR MAKING THE SAME

FIELD

The present disclosure is generally related to antenna systems and, more particularly, to a wide band antenna array that can be used as a structural, load-bearing portion of a mobile platform.

BACKGROUND

Many mobile platforms, such as aircraft, spacecraft, land vehicles or marine vehicles, often require the use of an antenna system for transmitting and receiving electromagnetic wave signals. The antenna system is often provided in the form of an array of antenna elements arranged in a grid-like pattern. The various components on which the antenna elements are mounted add undesirable weight to the mobile platform. Placement of antenna arrays on an exterior of the mobile platform may reduce aerodynamic efficiency. The expense required to manufacture antenna arrays can be significant due to the cost of materials, production time and procedures, and additional tooling fixtures needed. Such manufacturing and design disadvantages may limit the operational size of the antenna array, which limits the effective area of the antenna and impacts the performance of the antenna system.

Accordingly, those skilled in the art continue with research and development efforts in the field of antenna arrays.

SUMMARY

In one example, the disclosed structural antenna array may include a core including intersecting wall sections, wherein the core further includes antenna elements formed on a first surface of the wall sections, and feed elements formed on a second surface of the wall sections, a distribution substrate layer coupled to the core and in electrical communication with the antenna elements and the feed elements, a first skin coupled to the core opposite the distribution substrate layer, and a second skin coupled to the distribution substrate layer opposite the first skin.

In another example, the disclosed mobile platform may include a structural member, and a structural antenna array coupled to and forming a portion of the structural member, wherein the structural antenna array includes a core including intersecting wall sections, wherein the core also includes antenna elements formed on a first surface of the wall sections, and feed elements formed on a second surface of the wall sections, a distribution substrate layer coupled to the core and in electrical communication with the antenna elements and the feed elements, a first skin coupled to the core opposite the distribution substrate layer, and a second skin coupled to the distribution substrate layer opposite the first skin.

In yet another example, the disclosed method for making a structural antenna array may include the steps of: (1) forming a core including intersecting wall sections, wherein the wall sections include antenna elements formed on a first surface, feed elements formed on an opposed second surface, and connector pins coupled to the feed elements and the antenna elements, (2) connecting a frame around the core, (3) positioning a distribution substrate layer on the core, wherein the distribution substrate layer comprises a plurality of vias, (4) connecting the connector pins to the vias to mechanically couple the wall sections to the distribution substrate layer, (5) soldering the connector pins to the vias to electrically couple the feed elements and the antenna elements to the distribution substrate layer, (6) connecting RF connectors to the distribution substrate layer to electrically couple the feed elements and the antenna elements to the RF connectors, (7) positioning a first skin on the core opposite the distribution substrate layer, (8) positioning a second skin on the distribution substrate layer opposite the first skin, and (9) curing the core, the distribution substrate layer, the first skin, and the second skin.

Other examples of the disclosed apparatus and methods will become apparent from the following detailed description, the accompanying drawings and the appended claims.

DETAILED DESCRIPTION

Figure 1:
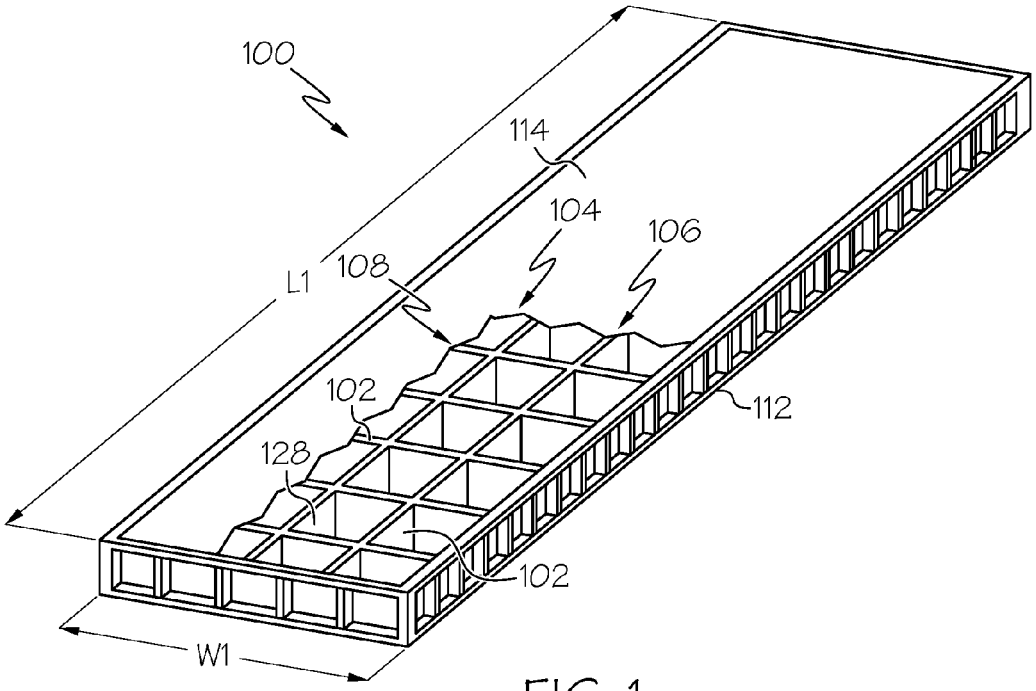
FIG. 1 is a schematic top perspective view of one example of the disclosed structural antenna array.

The following detailed description refers to the accompanying drawings, which illustrate specific examples described by the disclosure. Other examples having different structures and operations do not depart from the scope of the present disclosure. Like reference numerals may refer to the same feature, element or component in the different drawings.

Figure 13:
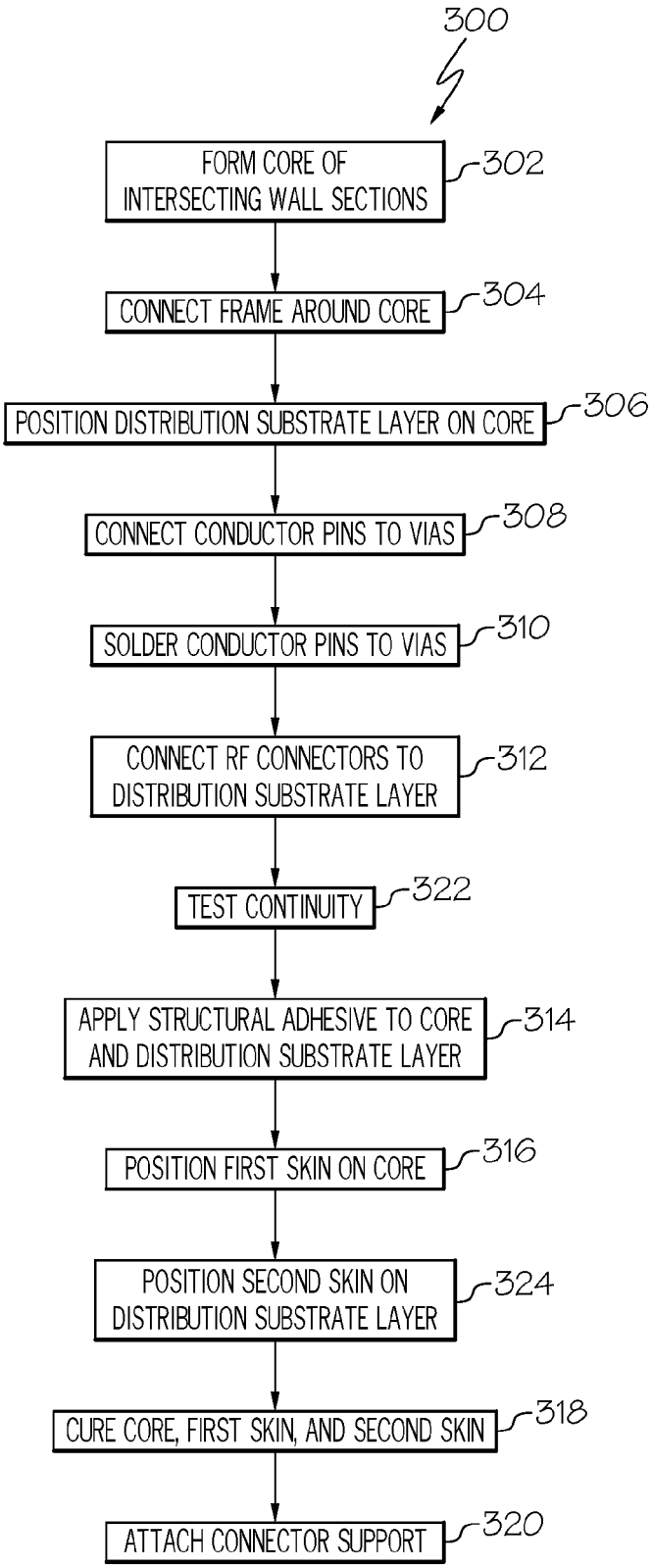
FIG. 13 is a flow diagram of one example of the disclosed method for making the structural antenna array.
Figure 22:
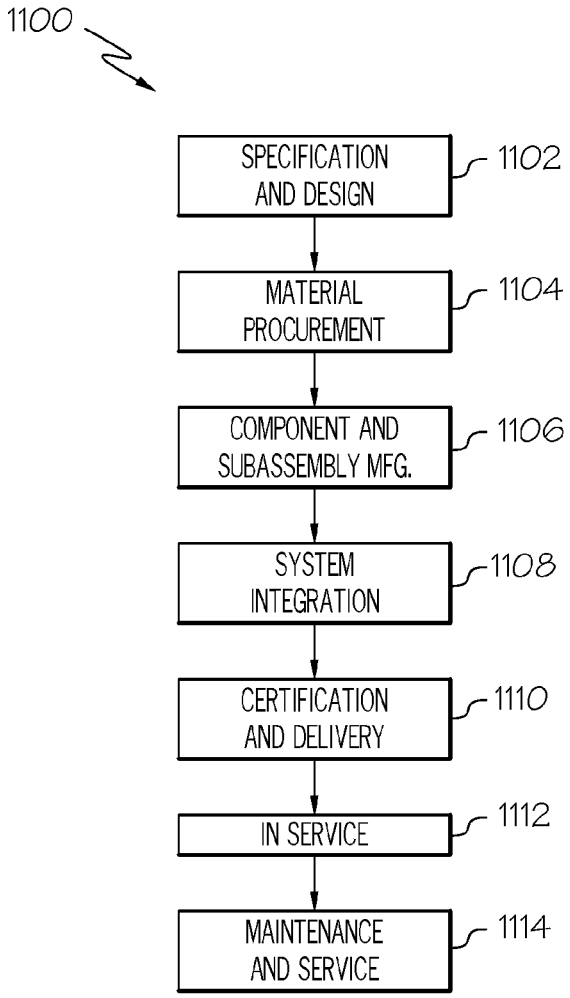
FIG. 22 is a block diagram of aircraft production and service methodology.

In FIGS. 13 and 22, referred to above, the blocks may represent operations and/or portions thereof and lines connecting the various blocks do not imply any particular order or dependency of the operations or portions thereof. Blocks represented by dashed lines indicate alternative operations and/or portions thereof. Dashed lines, if any, connecting the various blocks represent alternative dependencies of the operations or portions thereof. It will be understood that not all dependencies among the various disclosed operations are necessarily represented. FIGS. 13 and 22 and the accompanying disclosure describing the operations of the method(s) set forth herein should not be interpreted as necessarily determining a sequence in which the operations are to be performed. Rather, although one illustrative order is indicated, it is to be understood that the sequence of the operations may be modified when appropriate. Accordingly, certain operations may be performed in a different order or simultaneously. Additionally, those skilled in the art will appreciate that not all operations described need be performed.

Unless otherwise indicated, the terms "first," "second," etc. are used herein merely as labels, and are not intended to impose ordinal, positional, or hierarchical requirements on the items to which these terms refer. Moreover, reference to a "second" item does not require or preclude the existence of lower-numbered item (e.g., a "first" item) and/or a higher-numbered item (e.g., a "third" item).

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example and without limitation, two of item A, one of item B, and ten of item C; four of item B and seven of item C; or some other suitable combination.

Throughout the present disclosure, reference may be made to the spatial relationships between various components and to the spatial orientation of various aspects of components as the examples are depicted in the attached drawings. However, as will be recognized by those skilled in the art after a complete reading of the present disclosure, the examples described herein may be positioned in any orientation. Thus, the use of terms such as "top," "bottom," "front," "back," "above," "below," "upper," "lower," or other like terms to describe a spatial relationship between various components or to describe the spatial orientation of aspects of the examples described herein should be understood to describe a relative relationship between the components or a spatial orientation of aspects of such examples, respectively, as the examples described herein may be oriented in any direction.

Reference herein to "example," "one example," "another example," or similar language means that one or more feature, structure, element, component or characteristic described in connection with the example is included in at least one embodiment or implementation. Thus, the phrases "in one example," "as one example," and similar language throughout the present disclosure may, but do not necessarily, refer to the same example. Further, the subject matter characterizing any one example may, but does not necessarily, include the subject matter characterizing any other example.

Illustrative, non-exhaustive examples, which may be, but are not necessarily, claimed, of the subject matter according the present disclosure are provided below.

Figure 2:
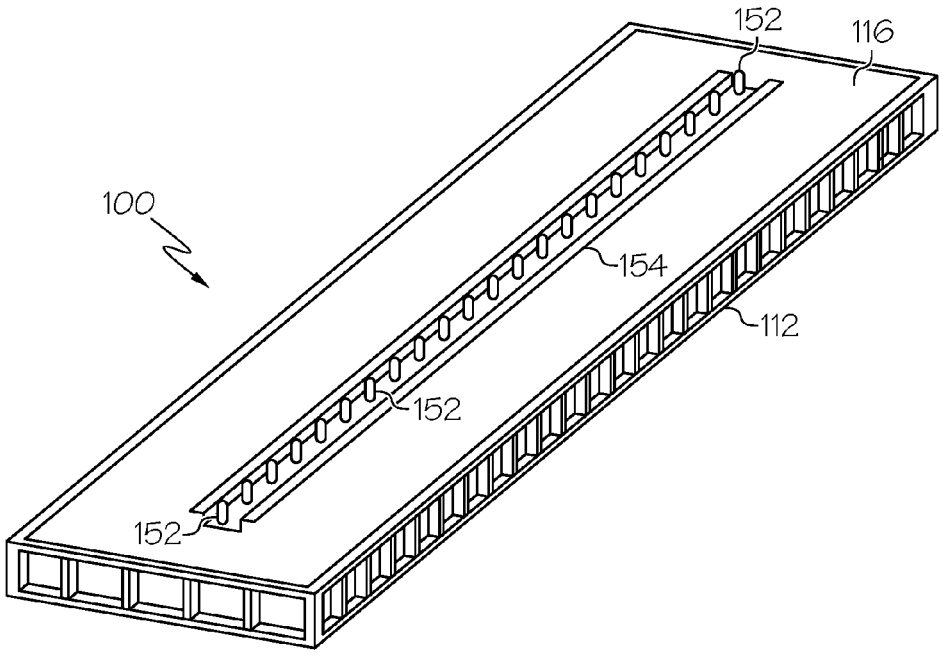
FIG. 2 is a schematic bottom perspective view of the structural antenna array of FIG. 1.

Referring to FIGS. 1 and 2, one embodiment of structural antenna array 100 is disclosed. Structural antenna array 100 forms a load bearing structural member that can be readily integrated into structural portions of a mobile platform (e.g., a vehicle such as an air vehicle, a marine vehicle, a land vehicle, etc.) without an undesirable change in the overall strength of the structural portion. Additionally, structural antenna array 100 may not add significant additional weight beyond what would be present with a conventional structural member that does not incorporate antenna capabilities.

Generally, structural antenna array 100 defines an antenna aperture or effective area of an antenna oriented perpendicular to a direction of incoming radio waves and configured to receive radio waves. Structural antenna array 100 includes a first (e.g., longitudinal) dimension (identified herein as length L1) and a second (e.g., lateral) dimension (identified herein as width W1) (FIG. 1). Generally, structural antenna array 100 may be constructed to have any suitable dimensions based on a particular application. As one specific, non-limiting example, structural antenna array 100 may include a length L1 of approximately 74 inches and a width W1 of approximately 14 inches.

Structural antenna array 100 includes wall sections 102 (e.g., a plurality of wall sections 102) interconnected to form core 104. As one example, core 104 may be a honeycomb core or grid-like core formed by approximately parallel (e.g., longitudinal) rows 106 of wall sections 102 approximately perpendicularly interconnected with approximately parallel (e.g., lateral) columns 108 of wall sections 102. In the specific, non-limiting example of structural antenna array 100 having dimensions of 74 inches by 14 inches, core 104 of structural antenna array 100 may include ten rows 106 of longitudinally extending wall sections 102 and sixty-one columns 108 of laterally extending wall sections 102. Other numbers of wall sections 102 (e.g., rows 106 and/or columns 108) are also contemplated.

Figure 3:
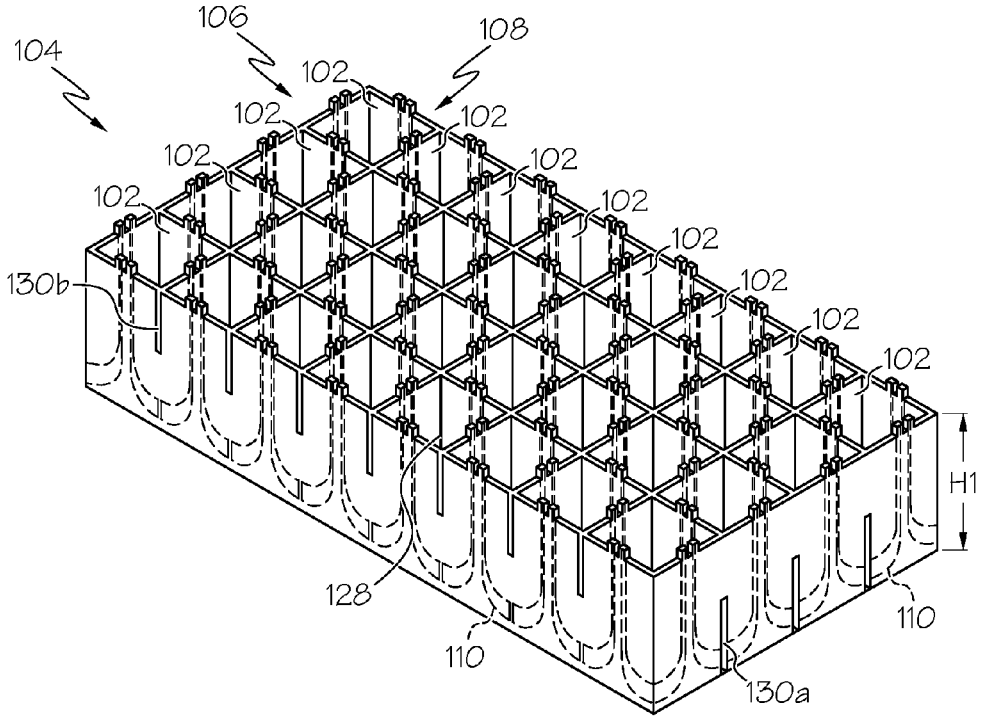
FIG. 3 is a schematic perspective view of one example of a core of the structural antenna array.
Figure 4:
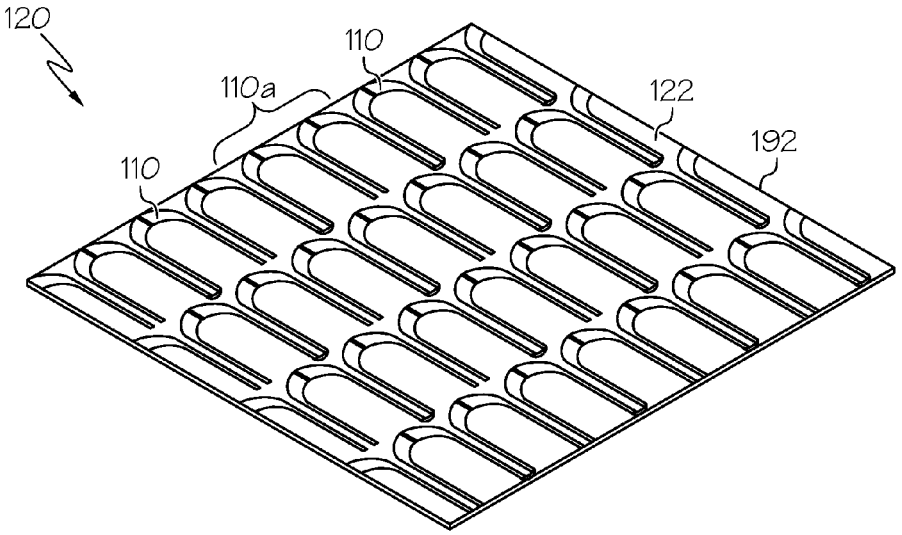
FIG. 4 is a schematic perspective view of a first side of a substrate layer formed with a plurality of antenna elements.
Figure 5:
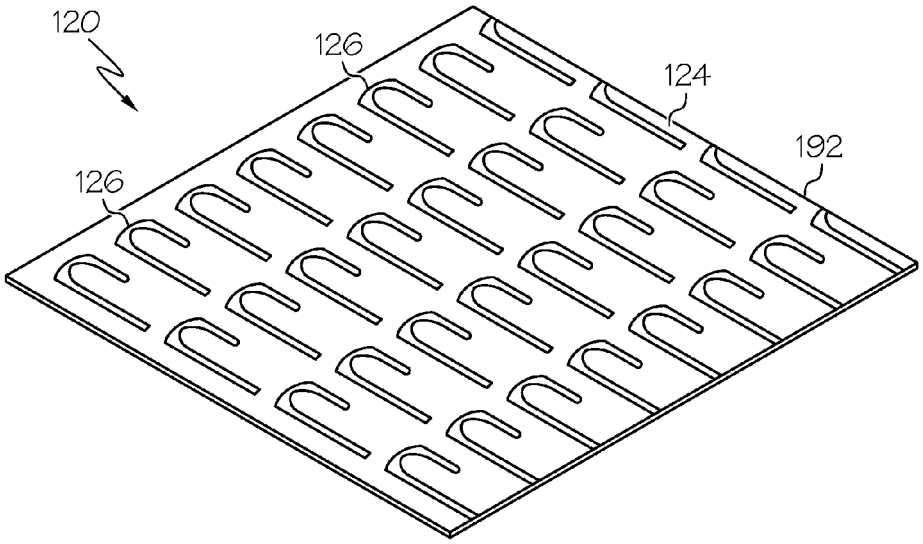
FIG. 5 is a schematic perspective view of a second side of the substrate layer of FIG. 4 formed with a plurality of feed elements.

While the examples of FIGS. 1 and 3 illustrate an X-Y grid-like arrangement of wall sections 102 forming core 104 having approximately square shaped openings (e.g., square antenna cells 128), other grid arrangements are also contemplated. For example, a honeycomb or grid-like core 104 having hexagonally shaped openings (e.g., hexagonal antenna cells 128) may also be formed by interconnecting wall sections 102. As such, the approximately perpendicular layout of wall sections 102 that form core 104 of structural antenna array 100 is intended to show one implementation of the grid-like layout of wall sections 102 and/or antenna elements 110 and feed elements 126 (FIGS. 3-5). The type of grid-like layout selected and the overall size of structural antenna array 100 may depend on a particular application with which structural antenna array 100 will be used.

Figure 9:
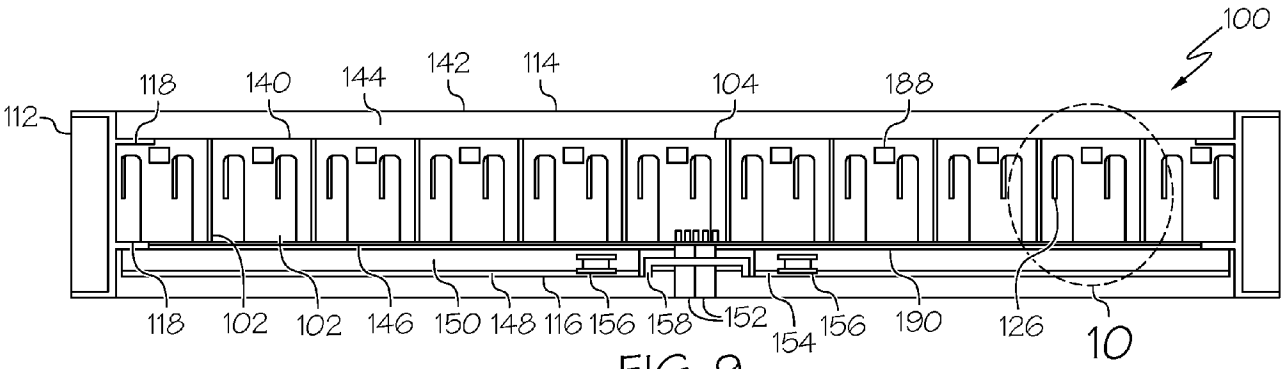
FIG. 9 is a schematic section view of one example of the structural antenna array.

Referring to FIG. 9, and with reference to FIGS. 1 and 2, structural antenna array 100 includes frame 112. Frame 112 fits around and supports core 104. As one example, core 104 fits between opposed (e.g., upper and lower, front and rear, etc.) flanges 118 of frame 112. Frame 112 stiffens core 104 and maintains a proper alignment of wall sections 102 (e.g., perpendicular alignment) and a proper shape (e.g., squareness) of core 104 and/or antenna cells 128. Frame 112 also provides attachment points for attachment of structural antenna array 100 to a structural portion of the mobile platform.

Structural antenna array 100 includes first (e.g., front) skin 114 (FIG. 1) and second (e.g., back) skin 116 (FIG. 2). First skin 114 (a portion of which has been cut away in FIG. 1 to better illustrate the grid-like arrangement of wall sections 102 forming core 104) and second skin 116 are coupled to core 104 (and distribution substrate layer 190) (not illustrated in FIGS. 1 and 2) to form a sandwich structure. Thus, structural antenna array 100 includes a layered structure formed by second skin 116, core 104, distribution substrate layer 190 (FIGS. 9 and 10), and first skin 114.

Structural antenna array 100 may provide sufficient structural strength to be capable of replacing a load bearing structure or structural member. As one example, in mobile platform applications, structural antenna array 100 may be used as a primary structural component in an aircraft, spacecraft, rotorcraft, or the like. Other possible applications may include use as a primary structural component in marine or land vehicles. Since structural antenna array 100 may be integrated into the structure of the mobile platform, it may not negatively impact the aerodynamics of the mobile platform as much as would be the case with an antenna or antenna array that is required to be mounted on an external surface of an otherwise highly aerodynamic, high speed mobile platform.

Referring to FIG. 3, and with reference to FIGS. 1, 4 and 5, each one of wall sections 102 (also identified herein as wall section 102) includes antenna elements 110 (e.g., a plurality of antenna elements 110) (FIG. 4) and feed elements 126 (e.g., a plurality of feed elements 126) (FIG. 5). Antenna elements 110 and feed elements 126 are embedded, integrated, attached, or otherwise formed on opposed surfaces of wall sections 102. Accordingly, structural antenna array 100 includes antenna cells 128 (e.g., a plurality of antenna cells 128) (FIG. 1). Antenna cells 128 are formed by interconnected wall sections 102, for example, arranged to form the grid-like (e.g., square cell) core 104. Core 104 of structural antenna array 100 includes rows 106 and columns 108 of antenna cells 128.

Antenna elements 110 may be flat (e.g., planar) conductive elements or microstrip antennas. As one example, antenna elements 110 are dipole antenna elements. As one non-limiting example, each one of antenna elements 110 (also referred to herein as antenna element 110) may be configured to operate in a frequency range of between approximately 2 GHz and approximately 4 GHz.

The perpendicular arrangement of wall sections 102 (e.g., forming square antenna cells 128) creates sets of orthogonal dipole antenna elements 110 to provide dual polarization. For example, certain ones of antenna elements 110 are horizontally polarized and certain other ones of antenna elements 110 (e.g., orthogonally oriented) are vertically polarized. In other examples, structural antenna array 100 may include only one set of dipole antenna elements 110 to provide single polarization.

Beneficially, structural antenna array 100 does not require the use of metallic substrates for supporting antenna elements 110 and/or feed elements 126. Structural antenna array 100 therefore may not have an undesirable parasitic weight penalty. As used herein, the term "parasitic" generally means weight that is associated with components of an antenna or an antenna array that are not directly necessary for transmitting or receiving operations. As such, structural antenna array 100 is a lightweight structure making it particularly well-suited and beneficial for aerospace applications.

Referring to FIGS. 4 and 5, in one example construction, substrate layer 120 is formed with antenna elements 110 on first surface 122 (FIG. 4) and feed elements 126 on second surface 124 (FIG. 5). As one example, antenna elements 110 are formed in approximately parallel rows on first surface 122 of substrate layer 120 and feed elements 126 are formed in approximately parallel rows on second surface 124 of substrate layer 120. Other arrangements of antenna elements 110 and/or feed elements 126 are also contemplated. Each pair of antenna elements 110 (also identified herein as antenna element pair 110*a*) (FIG. 4) on first surface 122 is associated with one of feed elements 126 (also identified herein as feed element 126) on the opposed second surface 124.

As one example, substrate layer 120 includes a non-conductive substrate material. As one example, substrate layer 120 may be a printed circuit board ("PCB") material or similar electronic circuit board material (generally referred to herein as electronic board material 192). As one general, non-limiting example, substrate layer 120 may be a glass-reinforced epoxy laminate (also generally known as FR-4). As one specific, non-limiting example, substrate layer 120 may be I-Tera® RF MT laminate commercially available from Isola Group, Chandler, Ariz.

First surface 122 and second surface 124 of substrate layer 120 are each coated with a copper foil (not explicitly illustrated) that is etched away to form antenna elements 110 on first surface 122 and feed elements 126 on second surface 124 having desired dimensions and relative spacing. A protective coating (not explicitly illustrated) may be applied to first surface 122 over antenna elements 110 and to second surface 124 over feed elements 126 to protect the copper foil forming antenna elements 110 and feed elements 126. As one example, the protective coating may be a non-conductive coating, such as a solder mask. Antenna elements 110 and feed elements 126 shown with broken lines in FIGS. 3, 6, 7, 8A, 8B, 8C and 10 to illustrate antenna elements 110 and feed elements 126 covered by protective coating. Similarly, feed elements 126 on second surface 124 of substrate layer 120 are shown with broken lines in FIGS. 8A and 10 to illustrate feed elements 126 covered (e.g., hidden) by protective coating and antenna elements 110 on first surface 122 of substrate layer 120 are shown with broken lines in FIGS. 8A and 10 to illustrate antenna elements 110 on the non-visible first surface 122 (e.g., hidden behind second surface 124).

Figure 8A:
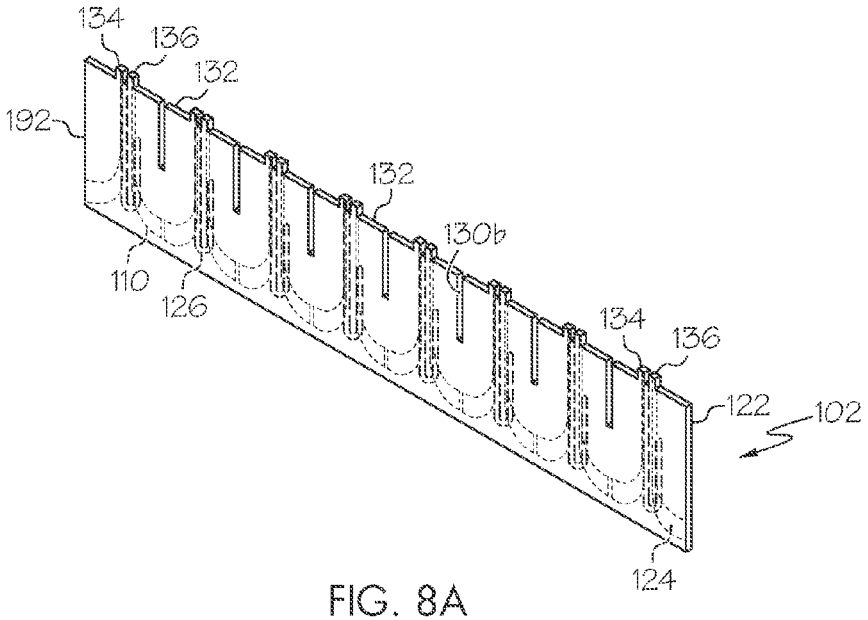
FIG. 8A is a schematic perspective view of one example of a wall section having connector pins formed on one edge at a terminal end of each feed element.
Figure 8B:
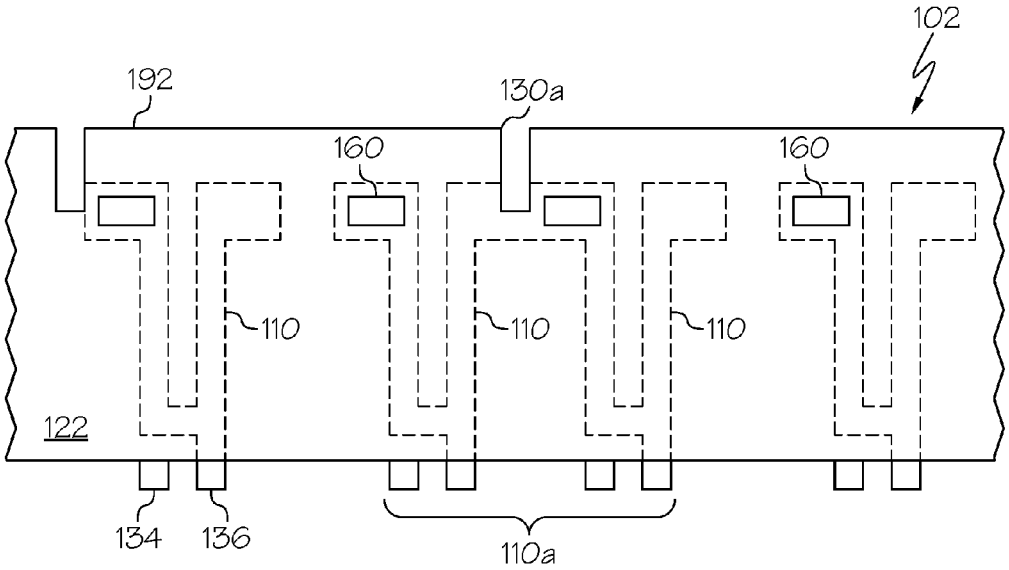
FIG. 8B is a schematic side elevational view of one example of the wall section showing a first surface having antenna elements.
Figure 8C:
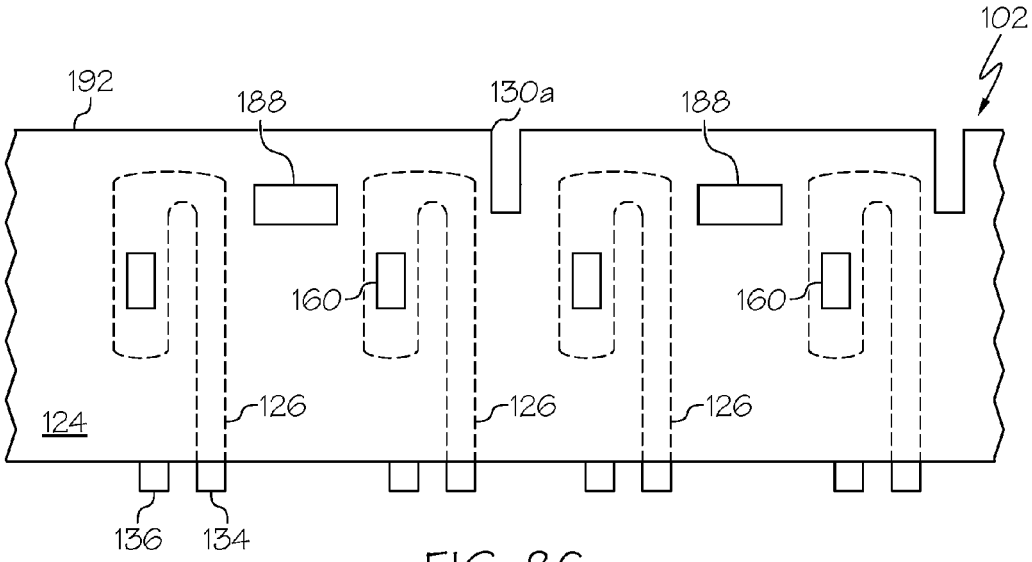
FIG. 8C is a schematic side elevational view of one example of the wall section showing a second surface having feed elements.

Referring to FIGS. 8B and 8C, in one example, a portion of one or more (e.g., each) antenna elements 110 and one or more (e.g., each) feed element 126 may be exposed (e.g., a portion of the copper foil not covered by the protective coating) to form test contact 160.

Figure 6:
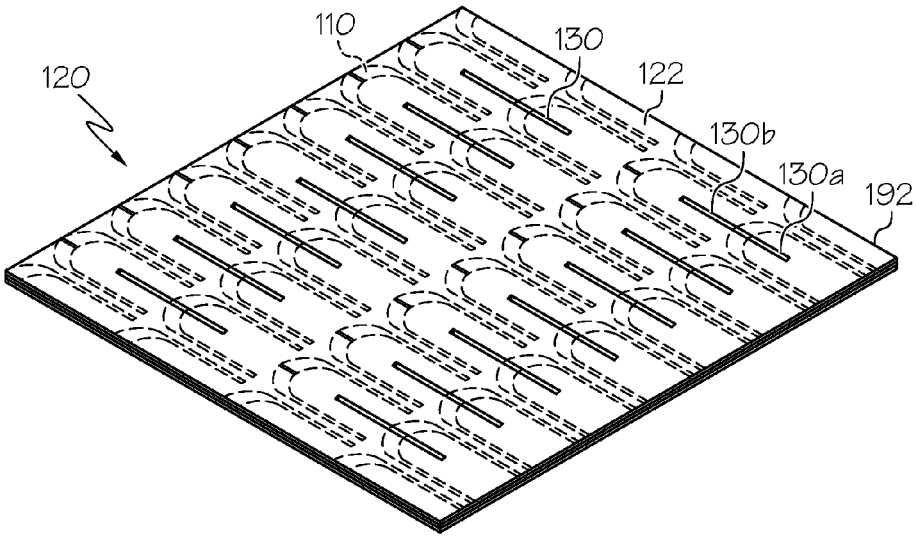
FIG. 6 is a schematic perspective view of the substrate layer of FIG. 4 showing wall slots formed to enable subsequent interlocking assembly of wall sections to form the core of FIG. 3.

Referring to FIG. 6, in one example construction, assembly wall slots 130 are formed into substrate layer 120 at spaced apart locations. Each one of wall slots 130 (also identified herein as wall slot 130) includes first (e.g., upper) portion 130*a* and second (e.g., lower) portion 130*b*. Wall slots 130 facilitate intersecting assembly of wall sections 102 to form core 104 (FIG. 3). As one example, wall slots 130 may be water jet cut or machine routed into substrate layer 120 to penetrate through an entire thickness of substrate layer 120.

Figure 7:
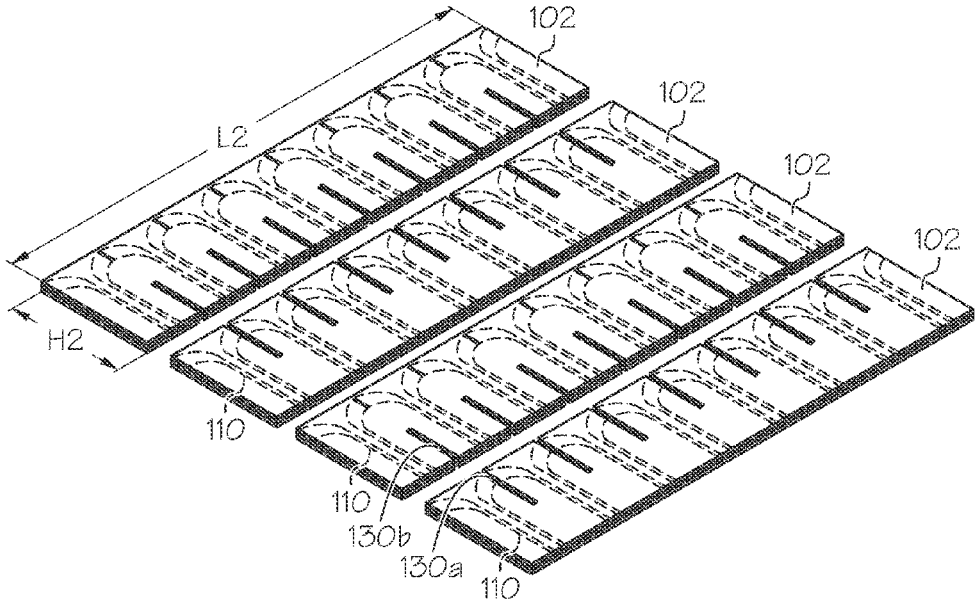
FIG. 7 is a schematic perspective view of the substrate layer of FIG. 6 cut into a plurality of wall sections to be used to form the core.

Referring to FIG. 7, as one example, substrate layer 120 may be cut into a plurality of sections or strips that form wall sections 102. Depending upon the overall length L2 of wall sections 102 and/or the desired overall dimensions (e.g., length L1 and/or width L2) of structural antenna array 100 (FIG. 1), one or more wall sections 102 may be cut to an appropriate length (e.g., to shorten the length of wall section 102). Height H2 of wall section 102 represents the overall height H1 (FIG. 3) of core 104 of structural antenna array 100.

Figure 10:
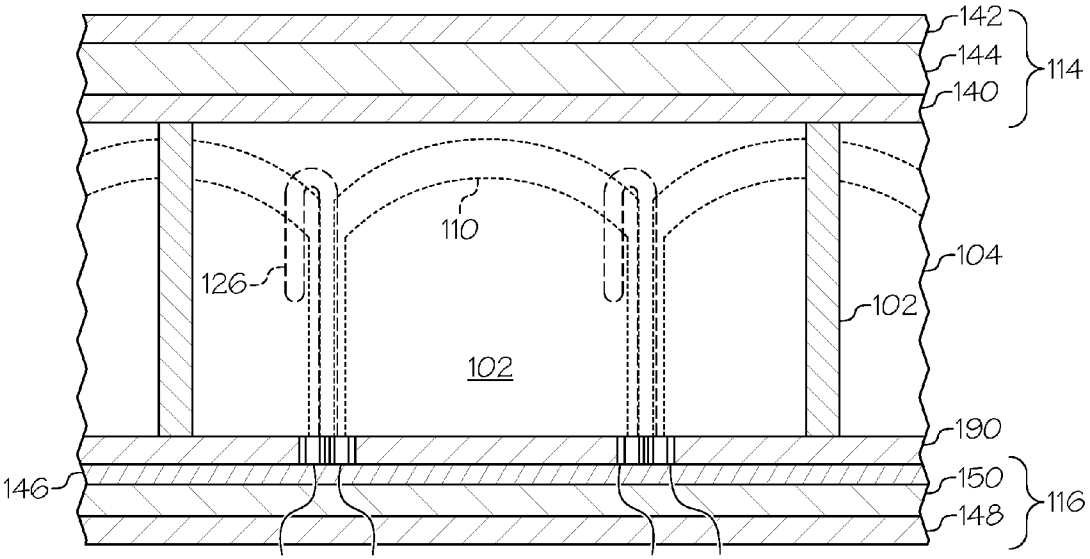
FIG. 10 is an enlarged schematic section view of a portion of the structural antenna array of FIG. 9.

Referring to FIGS. 8A, 8B and 8C, and with reference to FIG. 10, as one example, an edge (not explicitly identified) of each wall section 102 may be cut to form notches 132 between terminal ends of adjacent feed elements 126 and antenna elements 110. Notches 132 enable a terminal end of each feed element 126 to form first (e.g., signal) connector pin 134 (e.g., a first conductive foot) and a terminal end of each antenna element to form second (e.g., ground) connector pin 136 (e.g., a second conductive foot). Each first connector pin 134 and second connector pin 136 may be plated with a conductive material (e.g., covered with copper).

Referring to FIGS. 8B and 8C, in one example construction, pairs of antenna elements 110 (e.g., each antenna element pair 110*a*) may be directly (e.g., physically) coupled together (e.g., formed from a continuous strip of the copper material). Antenna element 110 of one antenna element pair 110*a* that is adjacent to antenna element 110 of another antenna element pair 110*a* may be capacitively coupled together. As one example, capacitive coupling pad 188 (FIG. 8C) may be coupled to second surface 124 (e.g., physically and electrically coupled to electronic board material 192). Capacitive coupling pad 188 may facilitate and enable capacitive connection and communication between antenna elements 110.

In one example, antenna elements 110 and feed elements 126 may be directly coupled (e.g., physically and electrically connected) together via connection to distribution substrate layer 190 (FIG. 10). In one example, antenna elements 110 and feed elements 126 may be capacitively coupled together (e.g., through the thickness of substrate layer 120) via capacitive coupling pad 188.

Referring to FIG. 10, and with reference to FIG. 9, as one example, first skin 114 and second skin 116 include multiple substrate material layers forming a sandwich structure (also referred to as a superstrate). As one example, first skin 114 includes first (e.g., inner) non-conductive substrate layer 140, second (e.g., outer) substrate layer 142, and a dielectric substrate layer 144 disposed between first non-conductive substrate layer 140 and second non-conductive substrate layer 142. Similarly, as one example, first skin 114 includes first (e.g., inner) non-conductive substrate layer 146, second (e.g., outer) substrate layer 148, and dielectric substrate layer 150 disposed between first non-conductive substrate layer 146 and second non-conductive substrate layer 148.

As one example, first non-conductive substrate layer 140 and second substrate layer 142 of first skin 114 and first non-conductive substrate layer 146 and second substrate layer 148 of second skin 116 may be electronic board material 192 (e.g., a PCB material or similar electronic circuit board material). As one general, non-limiting example, first non-conductive substrate layer 140, second substrate layer 142, first non-conductive substrate layer 146, and second substrate layer 148 may be a glass-reinforced epoxy laminate (also generally known as FR-4). As one specific, non-limiting example, first non-conductive substrate layer 140, second substrate layer 142, first non-conductive substrate layer 146, and second substrate layer 148 may be I-Tera® RF MT laminate. For example, first non-conductive substrate layer 140 and second substrate layer 142 of first skin 114 and/or first non-conductive substrate layer 146 and second substrate layer 148 of second skin 116 may include multiple plies (e.g., five plies) of I-Tera® RF MT that are cured to form a laminate structure.

As one example, dielectric substrate layer 144 of first skin 114 and dielectric substrate layer 150 of second skin 116 may be any suitable dielectric material that is an electrical insulator and allows electromagnetic waves (e.g., radio frequency ("RF") waves) to propagate through the material. As one general, non-limiting example, dielectric substrate layer 144 and dielectric substrate layer 150 may be a dielectric foam material. As one specific, non-limiting example, dielectric substrate layer 144 and dielectric substrate layer 150 may be Eccostock® Lok commercially available from Emerson & Cuming Microwave Products, Inc., Randolph, Mass. For example, dielectric substrate layer 144 of first skin 114 and dielectric substrate layer 150 of second skin 116 may include a sheet of Eccostock® Lok approximately 0.25 inch thick. The particular properties (e.g., dielectric constant) of the dielectric material of dielectric substrate layer 144 and/or dielectric substrate layer 150 may depend on (e.g., be selected based on) various antenna parameters including, but not limited to, operating frequency, bandwidth, and the like.

While the examples of first skin 114 and second skin 116 illustrated in FIG. 10 include three substrate layers (e.g., inner and outer non-conductive substrate layers and a dielectric substrate layer) other configurations or arrangements of substrate layers are also contemplated. As one example, first skin 114 and/or second skin 116 may include one or more additional non-conductive substrate layers disposed between the inner and outer non-conductive substrate layers.

First skin 114 and second skin 116 provide structural stiffness to structural antenna array 100. The dielectric material of dielectric substrate layer 144 of first skin 114 and dielectric substrate layer 150 of second skin 116 may be chosen to appropriately tune the RF transmission and reception capabilities of structural antenna array 100 (e.g., of antenna elements 110). For example, the dielectric material of dielectric substrate layer 144 of first skin 114 and dielectric substrate layer 150 of second skin 116 may be selected to suitably work with the attenuation of antenna elements 110. In one example, the dielectric properties of dielectric substrate layer 144 of first skin 114 and dielectric substrate layer 150 of second skin 116 may be the same. In one example, the dielectric properties of dielectric substrate layer 144 of first skin 114 and dielectric substrate layer 150 of second skin 116 may be different to tune structural antenna array 100. As one example, a thickness of dielectric substrate layer 144 and/or dielectric substrate layer 150 may be modified based on particular performance parameters.

Referring to FIG. 10, and with reference to FIG. 9, as one example, structural antenna array 100 includes distribution substrate layer 190 (e.g., an electronic distribution board). Core 104 (e.g., each one of interconnected wall sections 102) may be mechanically and electrically coupled to distribution substrate layer 190. As best illustrated in FIG. 10, distribution substrate layer 190 is disposed between core 104 and second skin 116.

As one example, distribution substrate layer 190 includes a non-conductive substrate material. As one example, distribution substrate layer 190 may be electronic board material 192 (e.g., a PCB material or similar electronic circuit board material). As one general, non-limiting example, distribution substrate layer 190 may be a glass-reinforced epoxy laminate (also generally known as FR-4). As one specific, non-limiting example, distribution substrate layer 190 may be I-Tera® RF MT laminate. For example, distribution substrate layer 190 may include multiple plies (e.g., five plies) of I-Tera® RF MT that are cured to form a laminate structure.

As one example, distribution substrate layer 190 includes vias 138. Vias 138 are holes formed at least partially through the thickness of distribution substrate layer 190. First connector pins 134 and second connector pins 136 of wall sections 102 (e.g., the terminal ends of antenna elements 110 and feed elements 126) are inserted into vias 138 to mechanically couple wall sections 102 to distribution substrate layer 190 (e.g., to mechanically couple core 104 to distribution substrate layer 190). Vias 138 may be plated with a conductive material (e.g., covered with copper) to electrically couple feed elements 126 to distribution substrate layer 190. Vias 138 are electrically interconnected throughout distribution substrate layer 190 by a plurality of conductive tracks or traces (not explicitly illustrated) extending throughout distribution substrate layer 190. Thus, distribution substrate layer 190 electrically interconnects antenna elements 110 and feed elements 126 together and to radio transceiver electronics (not explicitly illustrated), for example, of the mobile platform.

Referring to FIG. 9, and with reference to FIG. 2, as one example, radio frequency ("RF") connectors 152 (e.g., a plurality of RF connectors 152) are mechanically and electrically coupled to distribution substrate layer 190. RF connectors 152 may be any suitable RF connector, such as a coaxial RF connector.

As one example, RF connectors 152 are mechanically and electrically coupled to vias 138 formed in distribution substrate layer 190. RF connectors 152 are electrically coupled to feed elements 126 and/or antenna elements 110 by the plurality of conductive tracks or traces extending throughout distribution substrate layer 190. Thus, distribution substrate layer 190 serves as an electronics distribution vehicle that integrates feed elements 126 and antenna elements 110 of wall sections 102. In other words, antenna elements 110 and feed elements 126 are physically connected to RF connectors 152 by distribution substrate layer 190. Structural antenna array 100 may be coupled to the radio transceiver electronics (not explicitly illustrated) of the mobile platform by RF connectors 152.

In one example, a portion of feed elements 126 (e.g., a selected plurality of feed elements 126) and/or a portion of antenna elements 110 (e.g., a selected plurality of antenna elements 110) are coupled to and associated with pairs of RF connectors 152. As one example, feed elements 126 and/or antenna elements 110 of at least one column 108 of antenna cells 128 (e.g., wall sections 102 forming antenna cells 128) are associated with two RF connectors 152. One of the two RF connectors 152 may be associated with horizontally polarized antenna elements 110 and another one of the two RF connectors 152 may be associated with vertical polarized antenna elements 110.

Accordingly, structural antenna array 100 operates in a wide band (e.g., S-band) frequency range, for example, between approximately 2 GHz and approximately 4 GHz. Structural antenna array 100 is also dual polarized (e.g., is horizontally and vertically polarized).

Figure 11:
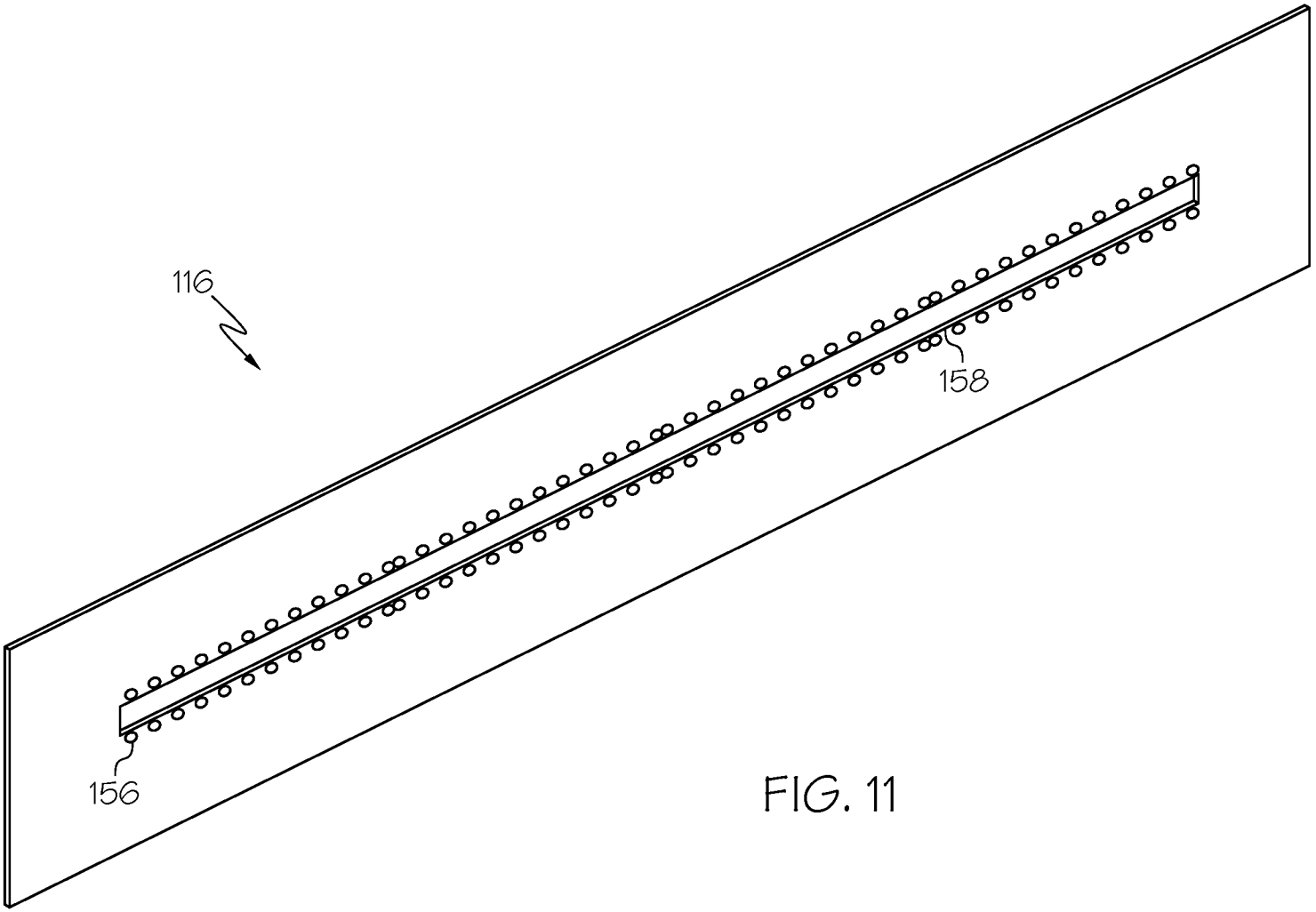
FIG. 11 is a schematic perspective view of one example of a second skin of the structural antenna array.

Referring to FIG. 11, and with reference to FIGS. 2, 9 and 10, in one example construction, skin slot 158 is formed in second skin 116. As one example, skin slot 158 may be water cut or machine routed at least into second skin 116 (e.g., at least partially through second non-conductive substrate layer 148 and dielectric substrate layer 150). Skin slot 158 facilitates access to RF connectors 152 (FIGS. 2 and 9) that are connected to distribution substrate layer 190. As best illustrated in FIG. 2, RF connectors 152 are aligned within and extend at least partially through skin slot 158.

Referring to FIG. 2, and with reference to FIG. 9, in one example construction, connector support 154 may be fit within skin slot 158 and coupled to second skin 116. Connector support 154 may support and reinforce RF connectors 152. As one example, connector support 154 is a rigid plate, for example, made of metal, having a plurality of holes (not explicitly illustrated) that are suitably sized and shaped to receive RF connectors 152.

Referring to FIG. 9, and with reference to FIG. 11, in one example construction, threaded inserts 156 may be installed in second skin 116 to facilitate connection of connector support 154. As one example, holes (not explicitly illustrated) may be formed (e.g., machined) at least partially through second non-conductive substrate layer 148 and dielectric substrate layer 150 of second skin 116 along side of skin slot 158. Threaded inserts 156 may be installed within the formed holes. A potting compound (not explicitly illustrated) may be used to bond threaded inserts 156 within second skin 116. Fasteners (not explicitly illustrated) may be connected to threaded inserts 156 for connection of connector support 154 to second skin 116.

As described above, depending upon the particular antenna application and/or the particular structural member of the mobile platform into which structural antenna array 100 is integrated, the overall dimensions (e.g., length L1 and/or width W1) (FIG. 1) of structural antenna array 100 may widely vary. Accordingly, core 104 may be made of or formed from a plurality of core sections or core portions connected together.

Figure 12:
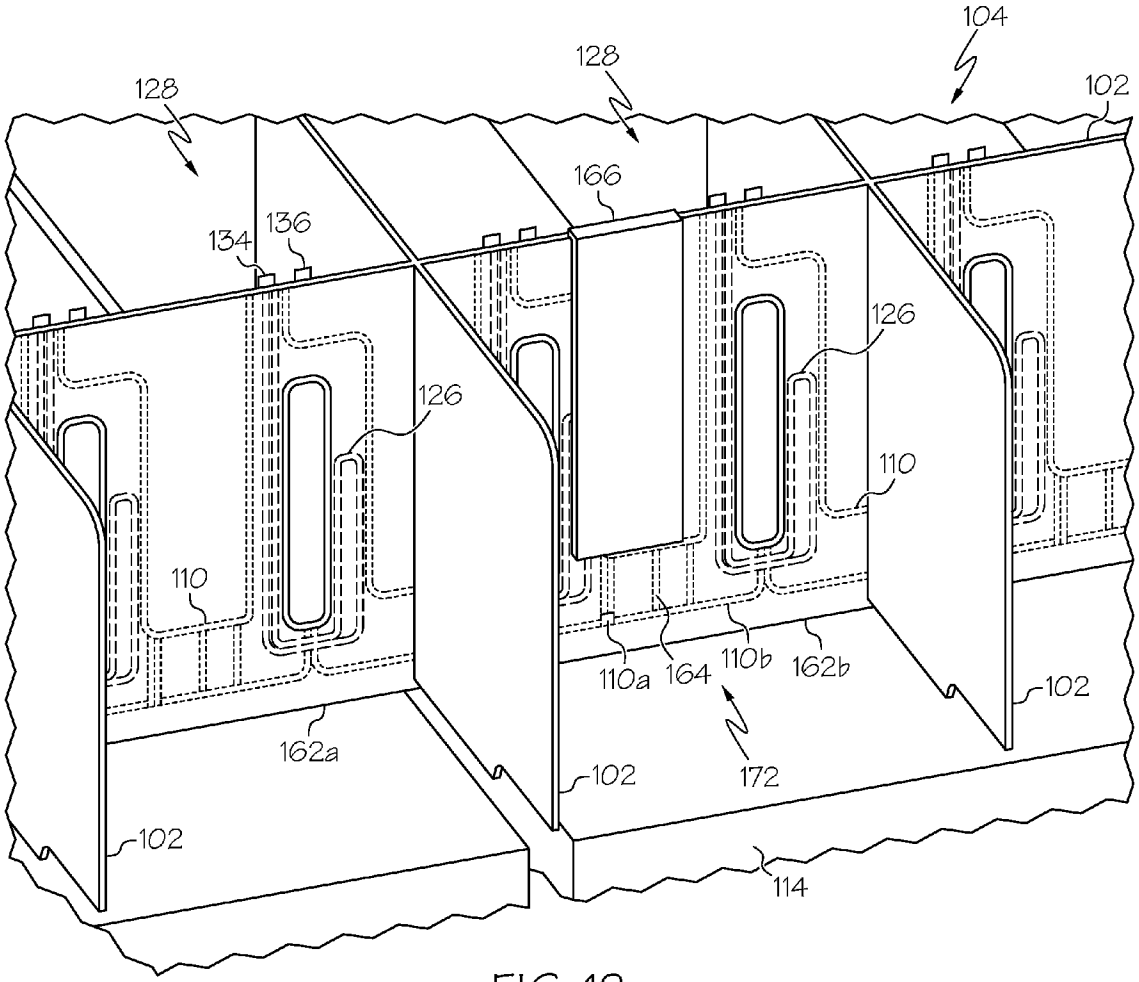
FIG. 12 is a schematic perspective view of one example of a splice location between adjacent wall sections forming the core.

Referring to FIG. 12, in one example construction, in order to make structural antenna array 100 having desired dimensions, one or more wall sections 102 may include two or more wall portions connected together. As one example, at least one wall section 102 includes first wall portion 162*a* and second wall portion 162*b*. Adjacent edges (not explicitly identified) of first wall portion 162*a* and second wall portion 162*b* are abutted together to form wall section 102. Conductive splice 164 may be used to electrically connect one of antenna elements 110 (e.g., half of antenna element 110*a*) of first wall portion 162*a* and to an adjacent one of antenna elements 110 (e.g., half of adjacent antenna element 110*b*) of second wall portion 162*b*. Conductive splice 164 may be made of any appropriate conductive material. As non-limiting examples, conductive splice 164 may be made of solder, foil, conductive adhesive, conductive mesh, or the like.

First wall portion 162*a* and second wall portion 162*b* may be physically joined and supported by structural non-conductive splice clip 166. Non-conductive splice clip 166 may be made of a structural non-conductive material. As one example, non-conductive splice clip 166 may be made of electronic board material 190 (e.g., PCB or other suitable electronic circuit board material). As one general, non-limiting example, non-conductive splice clip 166 may be a glass-reinforced epoxy laminate (also generally known as FR-4). As one specific, non-limiting example, non-conductive splice clip 166 may be I-Tera® RF MT laminate. Non-conductive splice clip 166 may be attached to wall section 102 (e.g., between first wall portion 162*a* and second wall portion 162*b*) over conductive splice 164. Non-conductive splice clip 166 may be attached to wall section 102 using a suitable non-conductive adhesive or other bonding agent. Non-conductive splice clip 166 is designed to not interfere with any exposed conductive material of wall section 102 (e.g., copper foil or other electronic pads).

Accordingly, structural antenna array 100 disclosed herein overcomes numerous disadvantages present in conventional structural antenna arrays including producability, expense, size and weight limitations, and RF performance. The use of electronic board material 190 to make wall sections 102, distribution substrate layer 190, first non-conductive substrate layer 146 and second non-conductive substrate layer 148 of second skin 116, and first non-conductive substrate layer 140 and second non-conductive substrate layer 142 of first skin 114 may eliminate producability issues arising due to mismatches of coefficient of thermal expansion between materials and reduce production costs. Second skin 116 and first skin 114 bonded to core 104 (and distribution substrate layer 190) produces a lightweight and strong structural member that can be integrated into another structure. Structural integration of structural antenna array 100 into a structural member of a mobile platform enables a significant increase in antenna aperture size over conventional antenna arrays.

Referring to FIG. 13, one example of method 200 is disclosed. Method 200 is one example implementation of the disclosed method for making structural antenna array 100. Modifications, additions, or omissions may be made to method 200 without departing from the scope of the present disclosure. Method 200 may include more, fewer, or other steps. Additionally, steps may be performed in any suitable order.

Referring to FIG. 13, and with reference to FIGS. 3-5, in one example implementation, method 200 includes the step of forming core 104 including intersecting wall sections 102, as shown at block 302. Wall sections 102 include electronic board material 190 having antenna elements 110 on first surface 122, feed elements 126 on second surface 124, and connector pins 134, 136 extending from an edge of wall sections 102 and coupled to feed elements 126 and antenna elements 110. As one example, wall sections 102 are perpendicularly interconnected, for example, by mating first portions 130*a* and second portions 130*b* of wall slots 130 to form rows 106 and columns 108 of antenna cells 128. Each one of antenna cells 128 (also referred to as antenna cell 128) includes an orthogonally oriented pair of antenna elements 110 (e.g., antenna element pair 110*a*) and an associated pair of feed elements 126 capacitively coupled to the pair of antenna elements 110.

Figure 14:
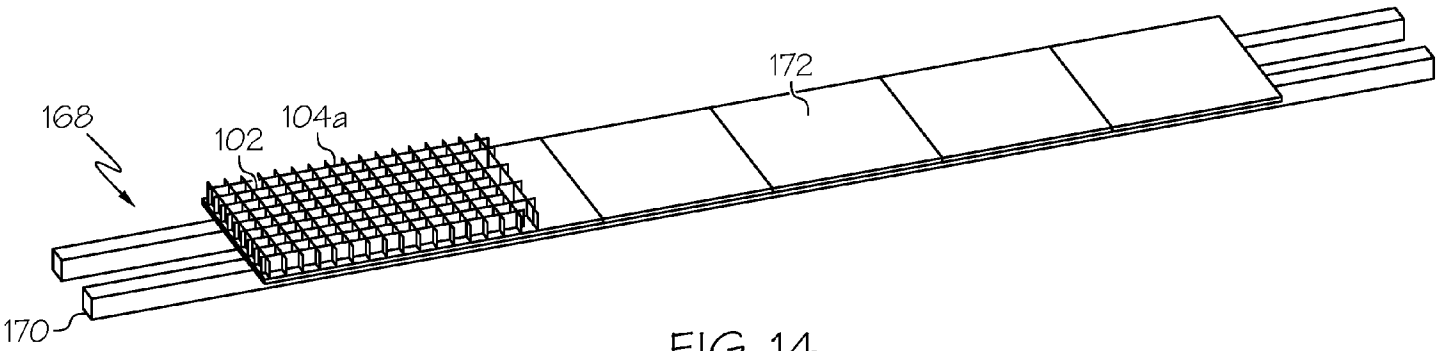
FIG. 14 is a schematic perspective view of one example of the core partially constructed on a first support member and support plates of tooling.
Figure 15:
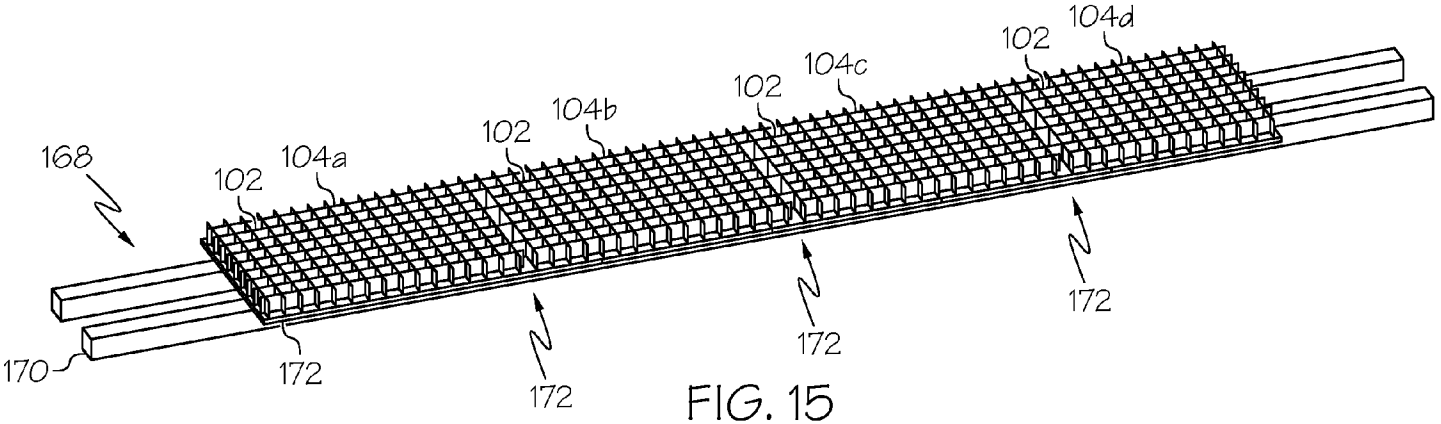
FIG. 15 is a schematic perspective view of the core entirely constructed on the tooling.
Figure 16:
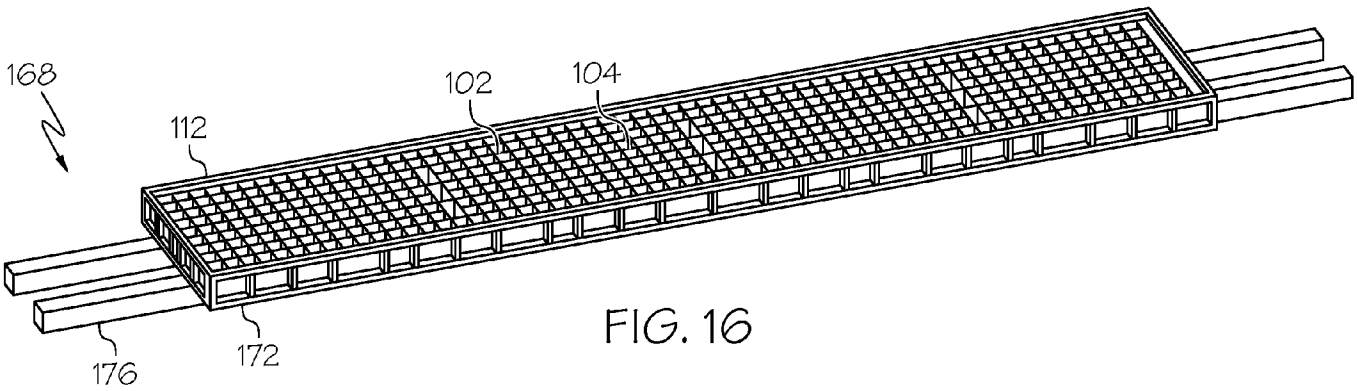
FIG. 16 is a schematic perspective view of one example of a frame connected around the core.

Referring to FIGS. 14 and 15, in one example implementation, tooling 168 may be used to construct structural antenna array 100. As one example, tooling 168 may include first support member 170 (e.g., a connected pair of tubing, channel, etc.) suitably sized and shaped to support structural antenna array 100. Tooling 168 may also include one or more support plates 172 positioned on first support member 170. Support plates 172 may be made of a material having similar thermal expansion properties (e.g., having a matching coefficient of thermal expansion) as that of wall sections 102, second skin 116 and first skin 114. As one general, non-limiting example, support plates 172 may be a glass-reinforced epoxy laminate (e.g., FR-4).

Core 104 may be constructed by interconnecting wall sections 102 on tooling 168 (e.g., on first support member 170 and support plates 172). As illustrated in FIG. 15, depending upon the overall length L1 (FIG. 1) of structural antenna array 100 and the length L2 (FIG. 7) of wall sections 102, core 104 may include a plurality of core sections (identified individually as first core section 104*a*, second core section 104*b*, third core section 104*c*, and fourth core section 104*d*). In such an example, adjacent wall sections 102 may be joined at splice locations 174 to form the longitudinal rows of wall sections 102. Joining adjacent wall section 102 (e.g., first wall portion 162*a* and second wall portion 162*b*) may be performed as described above and with reference to FIG. 12.

Referring to FIG. 13, and with reference to FIGS. 1, 2, 9 and 16, in one example implementation, method 200 includes the step of connecting frame 112 around core 104, as shown at block 304.

Figure 17:
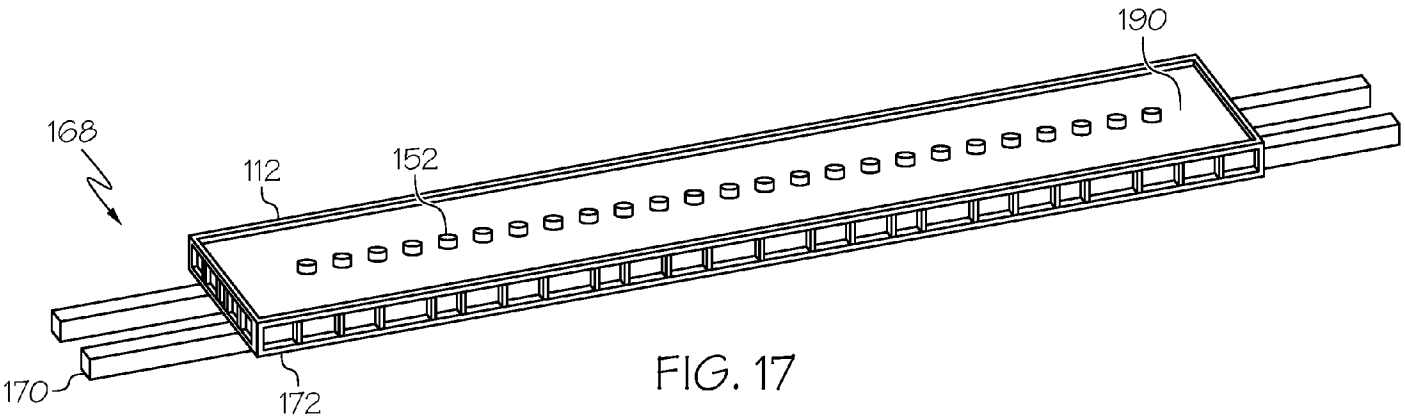
FIG. 17 is a schematic perspective view of one example of a distribution substrate layer positioned on the core.

Referring to FIG. 13, and with reference to FIGS. 9, 10 and 17, in one example implementation, method 200 includes the step of positioning distribution substrate layer 190 on core 104, as shown at block 306. As one example, distribution substrate layer 190 (FIG. 10) of is positioned on core 104 such that vias 138 (FIG. 10) formed in distribution substrate layer 190 are aligned with first connector pins 134 and second connector pins 136 extending from the edge of wall sections 102. Method 200 also includes the step of connecting connector pins 134, 136 to vias 138, as shown at block 308. Connecting (e.g., inserting) connector pins 134, 136 to vias 138 mechanically couples wall sections 102 to distribution substrate layer 190. Method 200 also includes the step of soldering connector pins 134, 136 to vias 138, as shown at block 310. Soldering connector pins 134, 136 to vias 138 electrically coupled feed elements 126 to distribution substrate layer 190.

Depending on the overall length of structural antenna array 100, distribution substrate layer 190 may be constructed from a plurality of distribution substrate layer sections (not explicitly illustrated). As one example, each distribution substrate layer section may include a section of distribution substrate layer 190. Each distribution substrate layer section may be spliced together (e.g., mechanically and electrically).

Referring to FIG. 13, and with reference to FIGS. 9 and 17, in one example implementation, method 200 also includes the step of connecting RF connectors 152 to distribution substrate layer 190, as shown at block 312. Connecting RF connectors 152 to distribution substrate layer 190 electrically couples RF connectors 152 to feed elements 126 and/or antenna elements 110. As one example, RF connectors 152 may be connected (e.g., inserted and soldered) to vias 138 in first non-conductive substrate layer 146.

Referring to FIG. 13, and with reference to FIGS. 8B and 8C, in one example implementation, method 200 includes the step of testing continuity of structural antenna array 110, as shown at block 322. As one example, after core 104 (e.g., wall sections 102) are coupled to distribution substrate layer 190, the electrical continuity of structural antenna array 110 may be tested using test contacts 160 of antenna elements 110 and/or feed elements 126 formed on wall sections 102. The ability to test the continuity and to verify proper function and operation of the electronic components (e.g., antenna elements 110, feed elements 126, RF connectors 152) of structural antenna array 100 prior to completion of construction (e.g., prior to application of a structural adhesive and/or connection of second skin 116 and/or first skin 114) beneficially allows repairs to be performed on structural antenna array 100.

Referring to FIG. 13, in one example implementation, method 200 includes the step of applying a structural adhesive (not explicitly illustrated) to core 104 and/or distribution substrate layer 190, as shown at block 314. As one example, the structural adhesive may be poured or sprayed onto core 104 and distribution substrate layer 190 and within each one of antenna cells 128 (FIG. 3). The structural adhesive may be a resin material suitable to structurally stabilize (e.g., bond) interconnecting edges of wall sections 102 to one another and wall sections 102 to distribution substrate layer 190.

Figure 18:
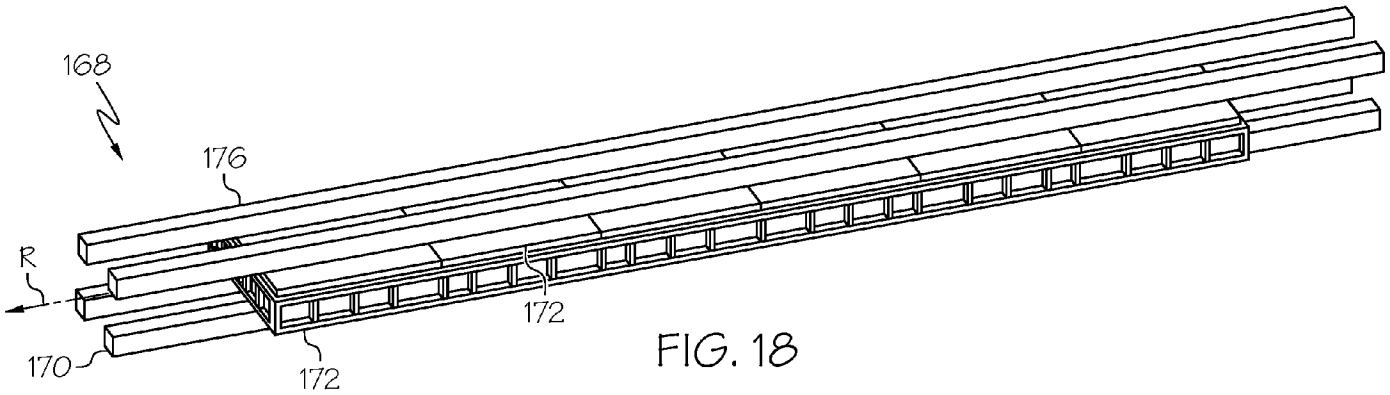
FIG. 18 is a schematic perspective view of one example of a second support member of the tooling used to clamp and rotate the structural antenna array.
Figure 19:
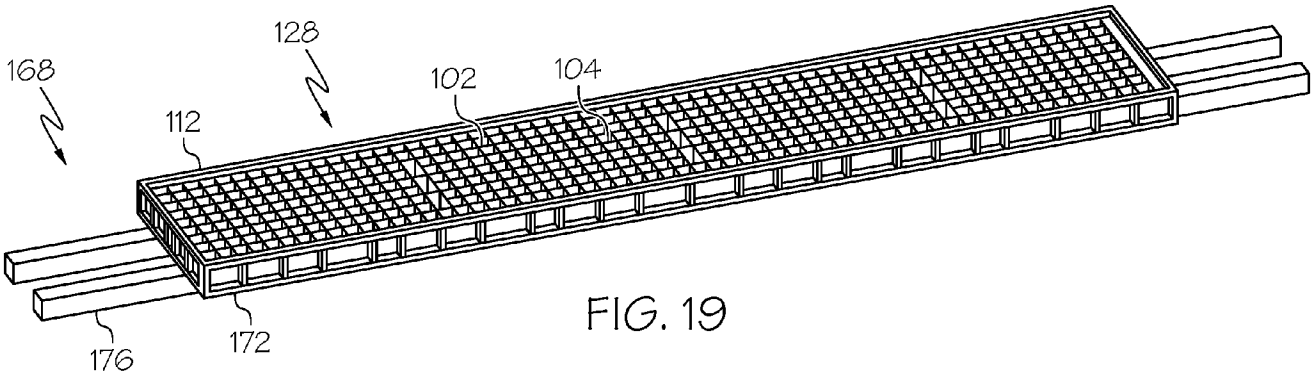
FIG. 19 is a schematic perspective view of the core, the frame, and the distribution substrate layer rotated and the first support member removed.

Referring to FIGS. 18 and 19, in one example implementation, tooling 168 may also include second support member 176. As one example, second support member 176 (e.g., a connected pair of tubing, channel, etc.) may be suitably sized and shaped to support structural antenna array 100 and clamp structural antenna array 100 between first support member 170 and second support member 176, for example, to rotate structural antenna array 100 about axis of rotation R, during construction. Additional support plates 172 may be positioned between structural antenna array 100 and second support member 176. For example, following connection of distribution substrate layer 190 to core 104, a partially constructed structural antenna array 100 (e.g., distribution substrate layer 190 and core 104) may be clamped between first support member 170 and second support member 176, rotated 180 degrees, and first support member 170 removed, for example, to expose antenna cells 128 and application of application of the structural adhesive to core 104 (e.g., wall sections 102) and distribution substrate layer 190 (block 314), as illustrated in FIG. 19.

Figure 20:
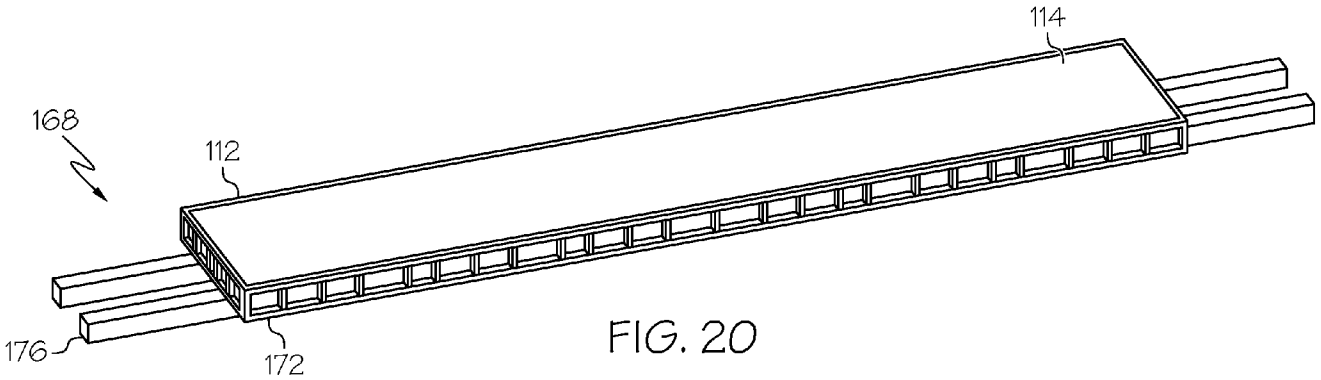
FIG. 20 is a schematic perspective view of one example of a first skin positioned on the core.

Referring to FIG. 13, and with reference to FIGS. 9, 10 and 20, method 200 includes the step of positioning first skin 114 on core 104, as shown at block 316. First skin 114 is positioned opposite distribution substrate layer 190. First skin 114 may be formed layer-by-layer. As one example, first non-conductive substrate layer 140 (FIG. 10) of first skin 114 is positioned on core 104. Dielectric substrate layer 144 (FIG. 10) of first skin 114 is positioned on first non-conductive substrate layer 140. Second non-conductive substrate layer 142 of first skin 114 is positioned on dielectric substrate layer 144. While not explicitly illustrated, first skin 114 may also include at least one adhesive layer, such as Metalbond® 1515-3 film adhesive, disposed between first non-conductive substrate layer 140 and dielectric substrate layer 144 and between dielectric substrate layer 144 and second non-conductive substrate layer 142. Similarly, at least one adhesive layer may be disposed between first skin 114 (e.g., first non-conductive substrate layer 140) and core 104. The adhesive layers bond first non-conductive substrate layer 140, dielectric substrate layer 144, second non-conductive substrate layer 142, and core 104 together, for example, during a curing operation.

Depending on the overall length of structural antenna array 100, first skin 114 may be constructed from a plurality of second skin sections (not explicitly illustrated). As one example, each second skin section may include a section of first non-conductive substrate layer 140, a section of dielectric substrate layer 144, and a section of second non-conductive substrate layer 142. Each second skin section may be spliced together.

Following application of first skin 114, first support member 170 and support plates 172 may be positioned on first skin 114 to clamp structural antenna array 100 between second support member 176 (and support plates 172) and first support member 170 (and support plates 172) and rotated 180 degrees for positioning of second skin 116. Second support member 176 and support plates 172 may be removed following rotation, as illustrated in FIG. 24.

Figure 24:
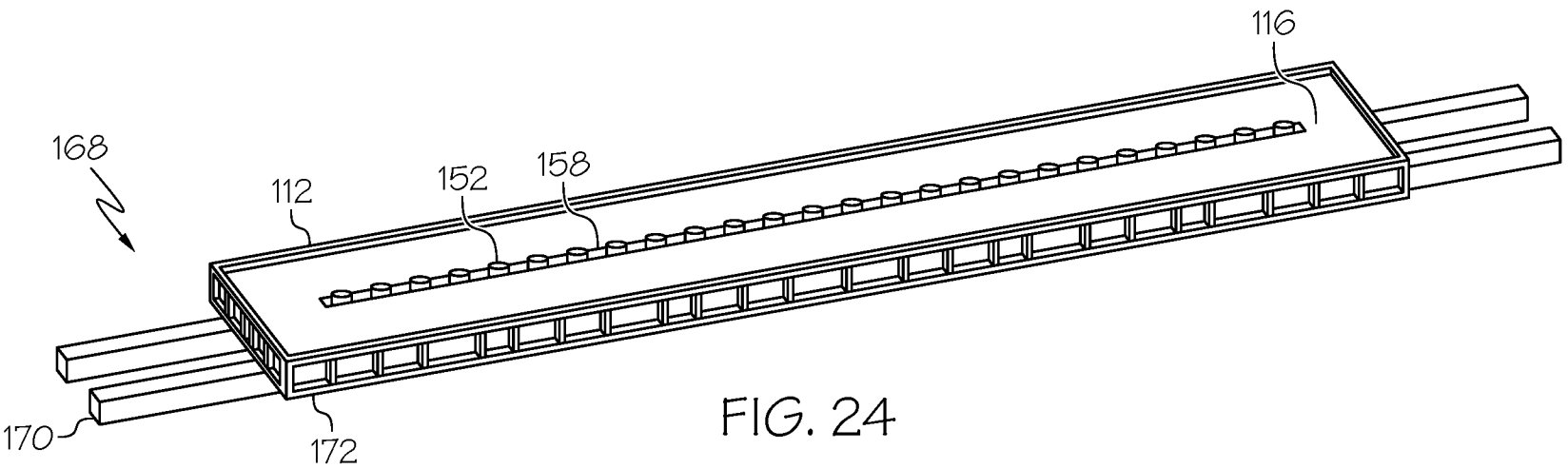
FIG. 24 is a schematic perspective view of one example of a second skin positioned on the distribution substrate layer.

Referring to FIG. 13, and with reference to FIGS. 9, 10 and 24, method 200 includes the step of positioning second skin 116 on distribution substrate layer 190, as shown at block 324. Second skin 116 may be positioned opposite first skin 114 to form the sandwich structure of second skin 116, core 104, distribution substrate layer 190, and first skin 114, as best illustrated in FIG. 10. Second skin 116 may be formed layer-by-layer on distribution substrate layer 190. As one example, first non-conductive substrate layer 146 (FIG. 10) of second skin 116 is positioned on distribution substrate layer 190. Dielectric substrate layer 150 (FIG. 10) of second skin 116 is positioned on first non-conductive substrate layer 146. Second non-conductive substrate layer 148 of second skin 116 is positioned on dielectric substrate layer 150. While not explicitly illustrated, second skin 116 may also include at least one adhesive layer, such as Metalbond® 1515-3 film adhesive commercially available from Cytec Industries, Inc., Woodland Park, N.J., disposed between first non-conductive substrate layer 146 and dielectric substrate layer 150 and between dielectric substrate layer 150 and second non-conductive substrate layer 148. Similarly, at least one adhesive layer may be disposed between second skin 116 (e.g., first non-conductive substrate layer 146) and distribution substrate layer 190. The adhesive layers bond first non-conductive substrate layer 146, dielectric substrate layer 150, second non-conductive substrate layer 148, and distribution substrate layer 190 together, for example, during a curing operation.

Depending on the overall length of structural antenna array 100, second skin 116 may be constructed from a plurality of first skin sections (not explicitly illustrated). As one example, each first skin section may include a section of first non-conductive substrate layer 146, a section of dielectric substrate layer 150, and a section of second non-conductive substrate layer 148. Each first skin section may be spliced together.

While the example of method 200 illustrates positioning first skin 114 on core 104 followed by positioning second skin 116 on distribution substrate layer 190, alternative orders of the steps of making structural antenna array 100 are also contemplated. For example, first skin 114 may be positioned on core 104 after second skin 116 is positioned on distribution substrate layer 190. As one example, second skin 116 may be positioned on distribution substrate layer 190 before rotation and application of the structural adhesive (block 314), and then first skin 114 may be positioned on core 104. As one example, second skin 116 may be positioned on distribution substrate layer 190 following application of the structural adhesive and rotation.

As illustrated in FIGS. 2, 9, 11 and 24, RF connectors 152 may extend through skin slot 158 formed in second skin 116 (e.g., formed through dielectric substrate layer 150 and second non-conductive substrate layer 148).

Referring to FIG. 13, in one example implementation, method 200 includes the step of curing structural antenna array 100 (e.g., the assembled combination of second skin 116, core 104, and first skin 114), as shown at block 318. Curing structural antenna array 100 may include heating second skin 116, core 104, distribution substrate layer 190, and first skin 114 to an appropriate temperature for an appropriate period of time, for example, in an oven. As one specific, non-limiting example, structural antenna array 100 may be cured at a temperature of approximately 250° F. for 120 minutes.

The use of electronic circuit board materials to form wall sections 102 and second skin 116 and first skin 114 having closely matched coefficients of thermal expansion enables an unpressurized curing operation (e.g., an out of autoclave cure), which may eliminate production issues that arise from mismatches of coefficient of thermal expansion between materials. Likewise, the use of support plates 172 having a coefficient of thermal expansion closely matching the electronic circuit board materials used to form wall sections 102 and second skin 116 and first skin 114 further reduces production issues that arise from mismatches of coefficient of thermal expansion between materials.

Referring to FIG. 13, and with reference to FIGS. 2 and 9, in one example implementation, method 200 includes the step of attaching connector support 154 to second skin 116, as shown at block 320.

Figure 21:
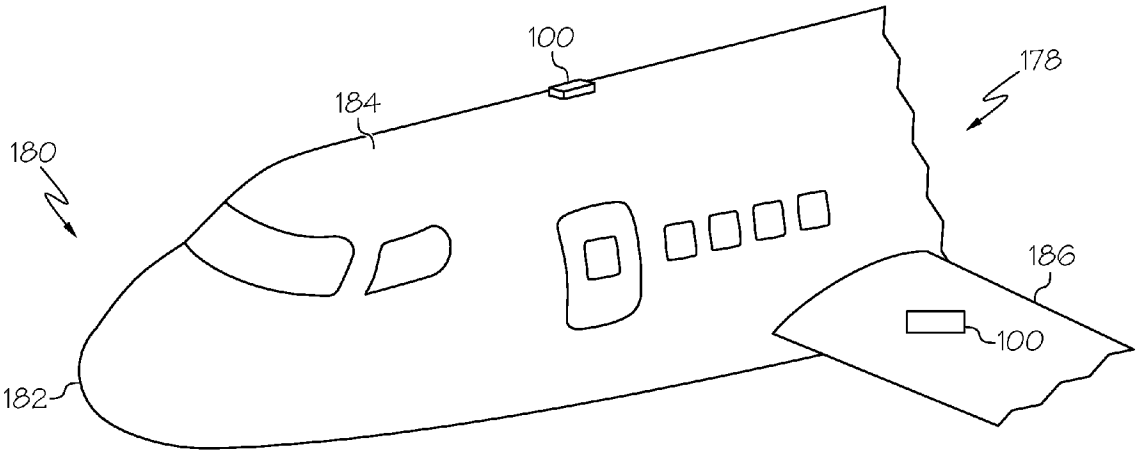
FIG. 21 is a schematic perspective view of one example of the structural antenna array integrally formed into a structural member of a mobile platform.

Referring to FIG. 21, in one example, the disclosed structural antenna array 100 is integrated within and forms a portion of structural member 178 of mobile platform 180. Structural member 178 may include any suitable primary structure of mobile platform 180. As one example, structural antenna array 100 may form a part of at least one of fuselage 184 or wing 186 of aircraft 182.

Figure 23:
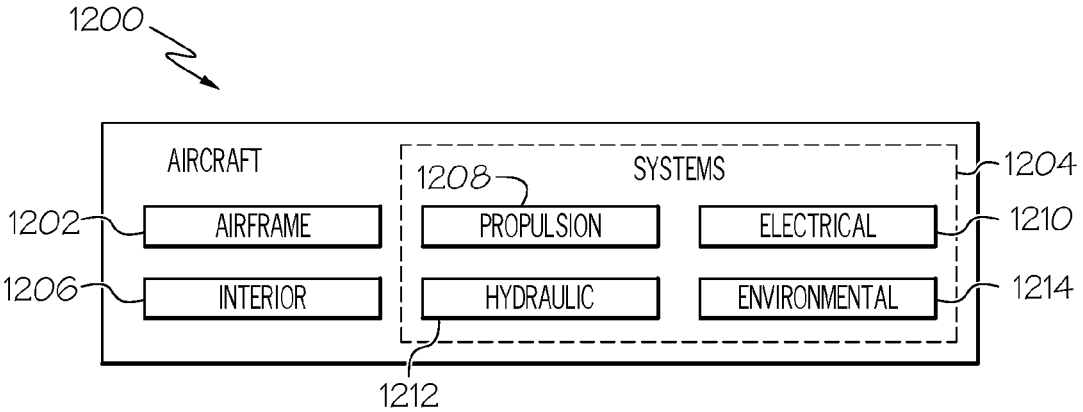
FIG. 23 is a schematic illustration of an aircraft.

Examples of structural antenna array 100 and methods for making structural antenna array 100 disclosed herein may be described in the context of aircraft manufacturing and service method 1100 as shown in FIG. 22 and aircraft 1200 as shown in FIG. 23. Aircraft 1200 may be one example of mobile platform 180 (e.g., aircraft 182) (FIG. 21). Aircraft applications of the disclosed examples of structural antenna array 100 may include, for example and without limitation, composite stiffened members such as fuselage skins, wing skins, control surfaces, hatches, floor panels, door panels, access panels, empennages, and the like.

During pre-production, the illustrative method 1100 may include specification and design, as shown at block 1102, of aircraft 1200, which may include design of structural antenna array 100 for a particular antenna capability, and material procurement, as shown at block 1104. During production, component and subassembly manufacturing, as shown at block 1106, and system integration, as shown at block 1108, of aircraft 1200 may take place. Fabrication of structural antenna array 100 as described herein may be accomplished as a portion of the production, component and subassembly manufacturing step (block 1106) and/or as a portion of the system integration (block 1108). Thereafter, aircraft 1200 may go through certification and delivery, as shown block 1110, to be placed in service, as shown at block 1112. While in service, aircraft 1200 may be scheduled for routine maintenance and service, as shown at block 1114. Routine maintenance and service may include modification, reconfiguration, refurbishment, etc. of one or more systems of aircraft 1200. Structural antenna array 100 may also be used during routine maintenance and service (block 1114).

Each of the processes of illustrative method 1100 may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

As shown in FIG. 17, aircraft 1200 produced by illustrative method 1100 may include airframe 1202 having one or more structurally integrated structural antenna arrays 100, and a plurality of high-level systems 1204 and interior 1206. Examples of high-level systems 1204 include one or more of propulsion system 1208, electrical system 1210, hydraulic system 1212 and environmental system 1214. Any number of other systems may be included. Although an aerospace example is shown, the principles disclosed herein may be applied to other industries, such as the automotive industry, the marine industry, and the like.

The apparatus and methods shown or described herein may be employed during any one or more of the stages of the manufacturing and service method 1100. For example, components or subassemblies corresponding to component and subassembly manufacturing (block 1106) may be fabricated or manufactured in a manner similar to components or subassemblies produced while aircraft 1200 is in service (block 1112). Also, one or more examples of the apparatus and methods, or combination thereof, may be utilized during production stages (blocks 1108 and 1110). Similarly, one or more examples of the systems, apparatus, and methods, or a combination thereof, may be utilized, for example and without limitation, while aircraft 1200 is in service (block 1112) and during maintenance and service stage (block 1114).

Although various examples of the disclosed structural antenna array and methods for making the same have been shown and described, modifications may occur to those skilled in the art upon reading the specification. The present application includes such modifications and is limited only by the scope of the claims.

What is claimed is:

1. A structural antenna array comprising:

a core comprising intersecting wall sections, wherein said core further comprises antenna elements formed on a first surface of said wall sections, and feed elements formed on a second surface of said wall sections;

a distribution substrate layer coupled to said core and in electrical communication with said antenna elements and said feed elements;

a first skin coupled to said core opposite said distribution substrate layer; and a second skin coupled to said distribution substrate layer opposite said first skin, wherein said first skin and said second skin each comprises:

a first non-conductive substrate layer;

a dielectric substrate layer coupled to said first non-conductive substrate layer; and a second non-conductive substrate layer coupled to said dielectric substrate layer opposite said first non-conductive substrate layer.

2. The structural antenna array of claim 1 wherein said antenna elements comprise dipole antenna elements.

3. The structural antenna array of claim 1 wherein said core comprises a square cell structure of said wall sections intersecting perpendicularly to form columns and rows of antenna cells.

4. The structural antenna array of claim 3 wherein each one of said antenna cells comprises at least one pair of said antenna elements oriented orthogonally to provide dual polarization.

5. The structural antenna array of claim 1 wherein each one of said wall sections comprises an electronic board material.

6. The structural antenna array of claim 1 wherein said distribution substrate layer comprises an electronic board material.

7. The structural antenna array of claim 1 further comprising RF connectors coupled to and in electrical communication with said distribution substrate layer.

8. The structural antenna array of claim 7 wherein pairs of said RF connectors are in electrical communication with selected ones of said feed elements and selected ones of said antenna elements.

9. The structural antenna array of claim 1 wherein at least one of said wall sections comprises a first wall portion, a second wall portion, and a conductive splice electrically connecting one of said antenna elements of said first wall portion to an adjacent one of said antenna elements of said second wall portion.

10. The structural antenna array of claim 9 further comprising a non-conductive splice clip connected to said first wall portion and said second wall portion over said conductive splice.

11. A mobile platform comprising:

a structural member; and a structural antenna array coupled to and forming a portion of said structural member, wherein said structural antenna array comprises:

a core comprising intersecting wall sections, wherein said core further comprises antenna elements formed on a first surface of said wall sections, and feed elements formed on a second surface of said wall sections;

a distribution substrate layer coupled to said core and in electrical communication with said antenna elements and said feed elements;

a first skin coupled to said core opposite said distribution substrate layer; and a second skin coupled to said distribution substrate layer opposite said first skin, wherein said first skin and said second skin each comprises:

a first non-conductive substrate layer;

a dielectric substrate layer coupled to said first non-conductive substrate layer; and a second non-conductive substrate layer coupled to said dielectric substrate layer opposite said first non-conductive substrate layer.

12. The mobile platform of claim 11 wherein:

each one of said wall sections comprises an electronic board material, said distribution substrate layer comprises said electronic board material, said first non-conductive substrate layer comprises said electronic board material, and said second non-conductive substrate layer comprises said electronic board material.

13. The mobile platform of claim 11 wherein:

said core comprises a square cell structure of said wall sections intersecting perpendicularly to form columns and rows of antenna cells, and each one of said antenna cells comprises at least one pair of said antenna elements oriented orthogonally to provide dual polarization.

14. The mobile platform of claim 11 wherein said antenna elements comprise dipole antenna elements.

15. The mobile platform of claim 11 further comprising RF connectors coupled to and in electrical communication with said distribution substrate layer.

16. The mobile platform of claim 11 wherein at least one of said wall sections comprises a first wall portion, a second wall portion, a conductive splice electrically connecting one of said antenna elements of said first wall portion to an adjacent one of said antenna elements of said second wall portion, and a non-conductive splice clip connected to said first wall portion and said second wall portion over said conductive splice.

17. The mobile platform of claim 11 wherein said structural member comprises at least one of a fuselage and a wing of an aircraft.

18. A structural antenna array comprising:

a core comprising intersecting wall sections, wherein said core further comprises antenna elements, formed on a first surface of said wall sections, and feed elements, formed on a second surface of said wall sections;

a distribution substrate layer coupled to said core and in electrical communication with said antenna elements and said feed elements;

a first skin coupled to said core opposite said distribution substrate layer; and a second skin coupled to said distribution substrate layer opposite said first skin; and wherein at least one of said wall sections comprises a first wall portion, a second wall portion, a conductive splice electrically connecting one of said antenna elements of said first wall portion to an adjacent one of said antenna elements of said second wall portion, and a non-conductive splice clip connected to said first wall portion and said second wall portion over said conductive splice.

19. The structural antenna array of claim 18 wherein said antenna elements comprise dipole antenna elements.

20. The structural antenna array of claim 18 wherein each one of said wall sections and said distribution substrate layer comprise an electronic board material.

* * * * *